US006171163B1

(12) United States Patent
Seko et al.

(10) Patent No.: US 6,171,163 B1
(45) Date of Patent: Jan. 9, 2001

(54) PROCESS FOR PRODUCTION OF FIELD-EMISSION COLD CATHODE

(75) Inventors: Nobuya Seko; Tadahiro Matsuzaki, both of Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/163,913

(22) Filed: Oct. 1, 1998

(30) Foreign Application Priority Data

Oct. 2, 1997 (JP) ..... 9-270001

(51) Int. Cl.[7] ..... H01J 9/00

(52) U.S. Cl. ..... 445/24; 438/460; 428/200; 428/206

(58) Field of Search ..... 438/460, 464; 445/24; 428/200, 260

(56) References Cited

U.S. PATENT DOCUMENTS

| | | | | |
|---|---|---|---|---|
| 3,475,213 | * | 10/1969 | Stow | 428/206 |
| 5,494,730 | * | 2/1996 | Calhoun et al. | 428/206 |
| 5,824,177 | * | 10/1998 | Yoshihara | 438/460 |

FOREIGN PATENT DOCUMENTS

| | | |
|---|---|---|
| 61-86248 | 5/1986 | (JP) . |
| 62-79649 | 4/1987 | (JP) . |
| 62-274742 | 11/1987 | (JP) . |
| 63-205383 | 8/1988 | (JP) . |
| 3-169045 | 7/1991 | (JP) . |
| 4-356942 | 12/1992 | (JP) . |
| 6-45436 | 2/1994 | (JP) . |
| 7-86212 | 3/1995 | (JP) . |
| 7-99172 | 4/1995 | (JP) . |
| 7-193027 | 7/1995 | (JP) . |
| 9-8109 | 1/1997 | (JP) . |

OTHER PUBLICATIONS

Japanese Office Action, dated Dec. 7, 1999, with English language translation of Japanese Examiner's comments.

* cited by examiner

*Primary Examiner*—Kenneth J. Ramsey
(74) *Attorney, Agent, or Firm*—McGuireWoods LLP

(57) ABSTRACT

A process for producing a field-emission cold cathode, which comprises steps of applying a protective sheet onto a wafer having a plurality of field-emitters formed at the surface and then dicing the resulting material to obtain individual devices, wherein the protective sheet is fitted to a frame for protective sheet and, in that state, is provided with preventive means for flowing adhesive, at the areas of the adhesive layer corresponding to the emitter areas, or wherein, at the time of the application of the protective sheet onto the wafer, the pressure applied to the protective sheet is reduced at the areas of the protective sheet corresponding to each emitter area, or wherein the protective sheet contains microspheres in the adhesive layer.

12 Claims, 21 Drawing Sheets

(a)

(b)

PROCESS FOR PRODUCTION OF FIELD-EMISSION COLD CATHODE

BACKGROUND OF THE INVENTION

1. Field of the Invention

The present invention relates to a process for production of a field-emission cold cathode having emitter electrodes each with an acute from end and particularly to an improved method for applying a protective sheet onto a wafer having a plurality of field-emitters formed at the surface, to later divide the cathodes into individual devices by dicing. The present invention also relates to a protective sheet suitably used in the method.

2. Description of the Related Art

"Field-emission cold cathode", was developed as an electron emitting source replacing "thermionic cathode" which emits electrons upon application of heat. Field-emission cold cathode emits electrons into air by quantum-mechanical tunneling which takes place when a strong electric field (2 to 5E7 V/cm or more) is generated at the acute front end of each emitter electrode. Therefore, the property of field-emission cold cathode is dependent upon the acuteness of emitter front end of each field-emitter, and it is said that the emitter front end is required to have a radius of curvature of several hundreds of angstrom (A) or less. Further, to generate an electric field such as above, it is necessary to arrange the two electrodes (emitter electrode and gate electrode) of field-emitter in close vicinity to each other (the distance between them is about 1 $\mu$m or less) and applying a voltage of several tens to several hundreds volts (V). The surface cleanness of emitter electrode affects its work function as well and is an important factor for determining the emittability of the electrode.

In actual application of field-emission cold cathode, several thousands to several tens of thousands of field-emitters are formed on a wafer and used as an array where they are connected in parallel, in many cases. Therefore, utilizing the technique used for fine processing of semiconductor produces them.

As an actual production process of field-emission cold cathode, there is a process developed by Spindt et al. of SRI (Stanford Research Institute) of U.S.A., described in J. Appl. Phys. 39, p. 3504, 1968. In the process, a refractory metal (e.g. molybdenum) is deposited on a conductive substrate to form a structure having an acute front end. The process is shown in FIG. 26.

First, on a silicon substrate 71 is formed an oxide film as an insulating layer 72. Subsequently, molybdenum is vacuum-deposited as a gate layer 74. Then, a resist 73 is applied, and photolithography and etching are conducted to form an aperture 77 having a diameter of about 1 $\mu$m. The insulating layer 72 is etched via the aperture 77 [FIG. 26(*a*)]. Thereafter, oblique deposition with rotation is conducted to form a sacrifice layer 78 made of aluminum. Then, molybdenum is vacuum-deposited in a vertical direction to form an emitter electrode 75 and a molybdenum film 76 [FIG. 26(*b*)]. Lastly, the sacrifice layer 78 is subjected to selective etching to lift off the molybdenum film 76 formed on the sacrifice layer 78, whereby a device structure is obtained [FIG. 26(*c*)].

In the device produced by the above process, when a voltage is applied so that the emitter electrode 75 becomes negative and the gate electrode 74 becomes positive, electrons are emitted from the front end of the emitter electrode 75 into a direction perpendicular to the substrate 71. Such a structure is generally called a vertical type field-emitter.

The applications of such a field-emission cold cathode include use as electron sources such as electron tube or the like. In the above process, as in the process generally used for production of semiconductor device, several hundreds to several thousands of devices are produced simultaneously in one wafer. In order to mount these devices on an electron tube, the devices must be divided into individual devices by dicing.

Dicing is a step of cutting a wafer by the use of a grindstone (an abrasive such as diamond, C-BN or the like) rotating at a high speed. Dicing is generally conducted by injecting cutting water on the cutting area of wafer for the purpose of cooling and prevention of sludge scattering. However, the cutting water flows on the wafer surface having devices formed and carries sludge (of silicon wafer and conductive substance such as electrode material or the like) to the vicinity of each emitter electrode. Remaining of sludge in the vicinity of emitter invites deterioration of the insulating property of emitter and impairs the reliability of device.

For alleviation of the above problems, it has been conducted to cover, at the time of dicing, a wafer with a protective sheet comprising a resin base material and an adhesive coated thereon, whereby the insulating property of emitter has been maintained at a satisfactory level.

The general procedure of the dicing step is described below.

First, onto the wafer surface after emitter formation and lift-off is applied a protective sheet comprising a base material and an UV-curing adhesive coated thereon. An adhesive sheet is applied onto the backside of the wafer, and dicing is conducted at the protective sheet side. In dicing, the cutting water containing sludge is injected onto the wafer surface; however, the presence of the protective sheet prevents direct contact of the water with the emitter area, whereby no defects such as poor insulation caused by dust, stain and the like arise.

After dicing, the protective sheet is peeled from the wafer. This peeling can be conducted easily, for example, by using an UV-curing adhesive as the adhesive of the protective sheet and applying an ultraviolet light onto the protective sheet surface to cure the adhesive and lower its adhesivity.

However, the adhesive of the protective sheet flows on the wafer by the pressure applied to the protective sheet for its application onto the wafer. As a result, as shown in FIG. 24, at the area where an emitter is formed, the adhesive of a protective sheet 22 comprising a base material 23 and an adhesive layer 24 penetrates into the aperture 77 of a gate electrode 74 and contacts with the front end of an emitter electrode 75. The depth of penetration of adhesive is about 0.25 $\mu$m when the gate aperture has a diameter of about 0.6 $\mu$m (an example of the measurement of penetration depth H ($\mu$m) by the present inventors was $H=D\times0.3+0.07$ when the gate diameter D was 0.6 to 1.6 $\mu$m). By peeling the protective sheet after dicing, the adhesive is removed and remaining of adhesive is not detectable even by SEM observation or the like. However, a very small amount of the adhesive remains on the emitter surface actually, which has increased the effective work function of emitter surface and has deteriorated the property of device.

FIG. 25 shows the emission properties of (1) a device produced by the above standard process (Adhesive Free: defined as "○") and (2) a device also produced by the above standard process (in this case, application of protective sheet, and peeling of the sheet were conducted to examine the effect of remaining adhesive, Adhesive Remained:

defined as "●"). The emission property of the latter device formed using a protective sheet was apparently inferior to that of the former device.

Japanese Patent Application Kokai (Laid-Open) No. 356942/1992 discloses the followings. When an adhesive layer is formed selectively on the areas of protective sheet slightly larger than the areas to be cut, the resulting protective sheet is applied onto a wafer, and dicing is made at the protective sheet side using a dicing machine, or when an UV-curing type adhesive layer is formed on the whole surface of protective sheet, a light-shielding mask is placed only on the areas of protective sheet slightly larger than the areas to be cut, an ultraviolet light is applied onto the protective sheet to cure the adhesive layer at the areas other than the areas to be cut, the resulting protective sheet is applied onto a wafer, and dicing is made at the protective sheet side using a dicing machine, there is no staining of the device surface by the adhesive and, because the protective sheet is bonded to the wafer only at the areas to be cut and the vicinities, there is no staining of the device surface by sludge, etc.

When the above practice is applied in production of field-emission cold cathode, it is presumed that no adhesive contacts with the front end of emitter electrode and that the reduction in emitter property caused by remaining of adhesive is prevented. However, formation of adhesive layer only on the areas of protective sheet slightly larger than the areas to be cut may cause partial peeling of applied protective sheet owing to the pressure applied thereto during dicing, the cutting water may penetrate into the device from the peeled area during dicing, and the intended purpose may not be achieved.

In order to prevent the above partial peeling of applied protective sheet, it is considered to use an adhesive of high adhesivity in formation of a protective film. The protective sheet used for dicing generally comprises a synthetic resin film having a thickness of about 50 to 100 $\mu$m and an adhesive layer formed thereon, and its rigidity is not so high. Usually, such a protective sheet is delivered from the supplier in the form of a roll and is used by drawing from the roll. When the protective sheet is drawn from its roll or subjected to looseness removal or aligning, the thin protective sheet, which shows considerable expansion and contraction, tends to expand towards a direction in which the protective sheet receives a force and contracts in a direction perpendicular thereto. When the adhesive layer is formed only on the areas of protective sheet slightly larger the areas to be cut, for example, in a width of the cutting width plus 60 $\mu$m (30 $\mu$m at one side of the cutting width) as described in Example of the above-mentioned literature, this 60 $\mu$m corresponds to 0.06% of wafer diameter when a wafer of 4 in. (10 cm) in diameter is used; when such a protective sheet is applied onto such a wafer, aligning at an accuracy of 0.06% is possible for one particular point of the wafer but is absolutely impossible for the whole wafer surface in view of the expansion and contraction of the protective sheet. Further, the wafer size is increasingly becoming larger, which makes the accuracy of aligning even more difficult. Misalignment and consequent adhesive absence on the areas to be cut or consequent presence of cured adhesive on the areas to be cut invites the penetration of cutting water into device and resultant reduction in emitter property.

Therefore, the width of adhesive application onto protective sheet must be large. However, when the width is large, the adhesive layer may cover the emitter area owing to the misalignment caused by the expansion and contraction of protective sheet. Thus, alignment conducted in application of protective sheet onto wafer is very difficult.

SUMMARY OF THE INVENTION

The present invention alleviates the above-mentioned problems of the prior art and provides a process for producing a field-emission cold cathode, in which process no adhesive is allowed to remain on the front end of emitter electrode by a simple method and thereby reduction in emitter property is suppressed.

The present invention lies firstly in a process for producing a field-emission cold cathode, which comprises steps of applying a protective sheet comprising a base material and an adhesive layer formed thereon, onto a wafer having a plurality of field-emitters formed at the surface and then dicing the resulting material to obtain individual field-emitters, wherein the protective sheet is fitted to a frame for protective sheet and, in that state, is provided with preventive means for flow of adhesive, at the areas of the adhesive layer corresponding to the emitter areas consisting of the plurality of field-emitters. In this process, it is desirable that the frame for protective sheet is provided with aligning means and that the formation of the preventive means for flow of adhesive and the application of the protective sheet onto the wafer are conducted by utilizing the aligning means.

The present invention lies secondly in a process for producing a field-emission cold cathode, which comprises steps of applying a protective sheet comprising a base material and an adhesive layer formed thereon, onto a wafer having a plurality of field-emitters formed at the surface and then dicing the resulting material to obtain individual field-emitters, wherein the application of the protective sheet onto the wafer is conducted by the use of a pressing tool having concave parts at the positions corresponding to each emitter area of cathode.

The present invention lies thirdly in a process for producing a field-emission cold cathode, which comprises steps of applying a protective sheet comprising a base material and an adhesive layer formed thereon, onto a wafer having a plurality of field-emitters formed at the surface and then dicing the resulting material to obtain individual field-emitters, wherein the protective sheet contains, in the adhesive layer, particles having diameters of 10 to 90% of the thickness of the adhesive layer.

In the present process, a protective sheet having protective areas for each emitter area can be applied onto a wafer having field-emitters at the surface, at a high aligning accuracy; or there is used a method for application of protective sheet onto wafer, which requires no alignment of protective sheet, or a protective sheet used in the method. Therefore, in the present process, it is possible to prevent the reduction in emitter property caused by the contact of adhesive with emitter (the reduction has been a problem), and a field-emission cold cathode of high reliability can be provided.

DETAILED DESCRIPTION OF THE PREFERRED EMBODIMENTS

Figure 1:
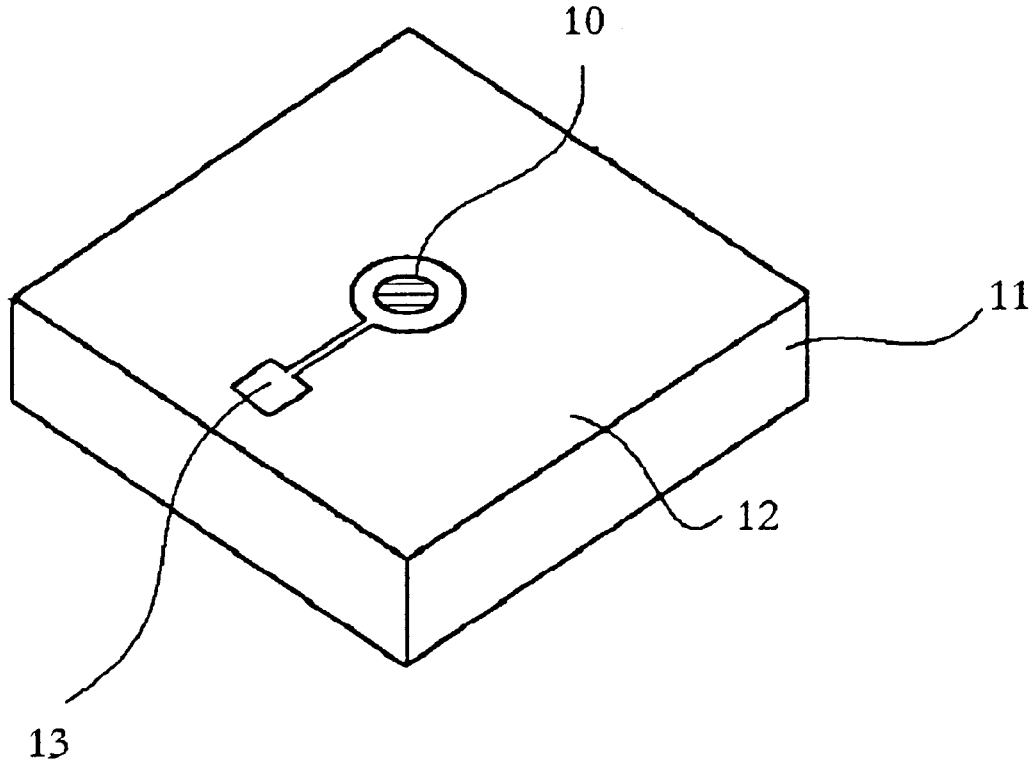
FIG. 1 is a perspective view showing an example of the field-emitter obtainable by the present process.

In the first process of the present invention, a protective sheet comprising a base material and an adhesive layer formed thereon is fitted to a frame, after which the protective sheet is provided with preventive means for flow of adhesive, at the adhesive layer; therefore, the misalignment between protective sheet and wafer, caused by the expansion or contraction of protective sheet can be prevented. The preventive means for flow of adhesive, formed at the adhesive layer of the protective sheet for safe application of protective sheet onto wafer are specifically either one of the following preventive means. In the following description, the areas of the protective sheet having such preventive means are called protective areas for each emitter area (hereinafter referred to simply as "protective areas").

1. The cured areas of the adhesive layer of protective sheet, obtained by using a photo-curing adhesive as the adhesive of the adhesive layer and, before the application of the protective sheet onto a wafer, applying a light to the areas of the adhesive layer corresponding to each emitter area of cathode, to cure the areas.
2. The thin films made of a material having a rigidity higher than that of the adhesive of the adhesive layer, formed on each area of the adhesive layer of protective sheet, correspond to each emitter area of cathode; or foils applied onto said area of the adhesive layer.
3. The adhesive-free areas of the adhesive layer of protective sheet, formed by coating an adhesive only on the areas of the base material of protective sheet, other than those corresponding to each emitter area of cathode, or by coating an adhesive on the whole surface of the base material and, before the application of the resulting protective sheet onto a wafer, removing the adhesive of only the areas corresponding to each emitter area of cathode.
4. The concave areas of the adhesive layer of preventive sheet, formed on the areas of the adhesive layer corresponding to each emitter area of cathode by pressing a convex tool.

The size of each protective area formed as above can be appropriately determined by taking into account the size of each emitter area of field-emission cold cathode and the adhesivity of adhesive. However, for example, when an emitter area of 0.1 to 0.8 mm in diameter is formed in a chip of 2 mm×2 mm, the protective area for this emitter area can be formed in a size about equal to that of the emitter area or in a size having a diameter larger by about 0.2 mm than that of the emitter area, i.e. a diameter of 0.3 to 1.0 mm.

In the second process of the present invention, a pressing tool having concave parts is used and the concave parts are allowed to correspond to each emitter area of cathode, independently of whether or not the protective sheet shows expansion or contraction; thereby, the pressure applied to each emitter area is reduced, the flow of adhesive is suppressed, and the contact of adhesive with front end of emitter electrode can be prevented.

In the third process of the present invention, the adhesive layer of the protective sheet contains fine spheres of given diameters; thereby, the flow of adhesive is suppressed and the contact of adhesive with front end of emitter electrode can be prevented.

By using any of the present processes, a field-emission cold cathode showing no reduction in emitter property can be provided.

EXAMPLE 1

In this Example is described a case wherein there is used a protective sheet comprising a synthetic resin film and an UV-curing type adhesive layer formed on one side of the film and, before the application of the protective sheet onto a wafer having a plurality of field-emitters formed at the surface, only the areas of the adhesive layer of the protective sheet corresponding to the emitter areas of the cathodes of the wafer are irradiated with an ultraviolet light to cure said areas of the adhesive layer.

Figure 26:
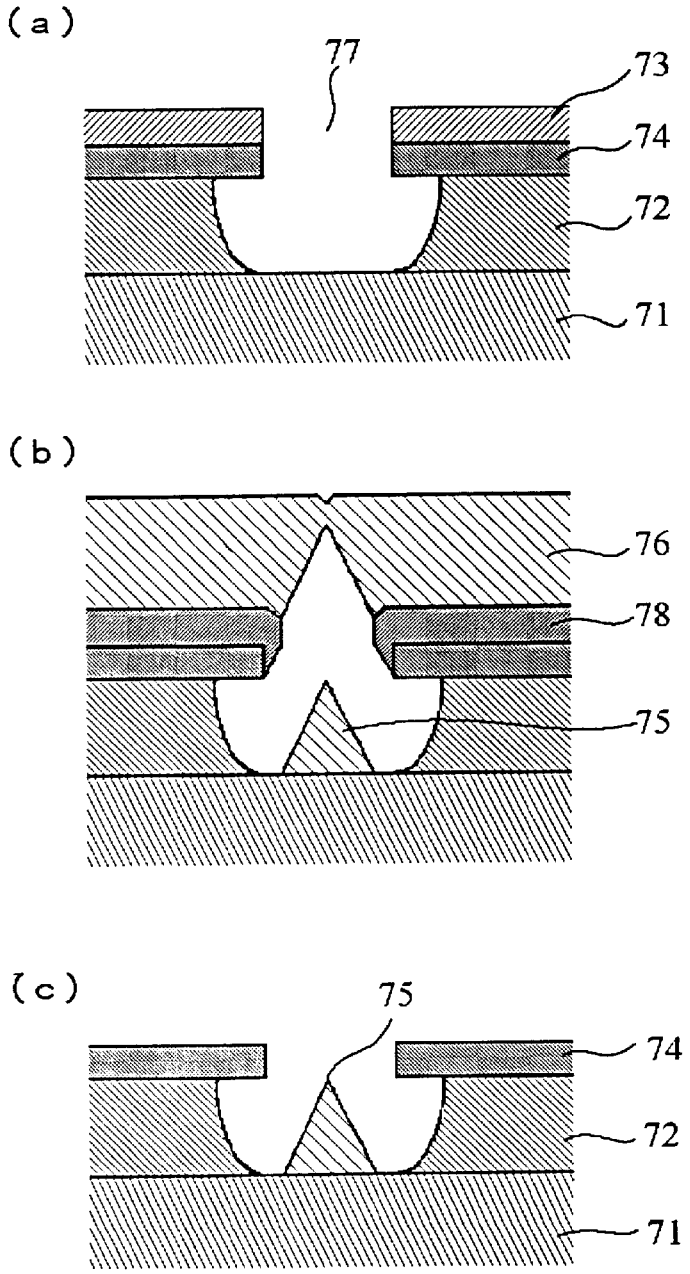
Fig. 26 (Prior Art)
FIG. 26 is schematic sectional views showing conventional steps of producing a Spindt type cold cathode.

In a field-emission cold cathode, several hundreds to several tens of thousands of very small field-emitters each having a gate aperture of about 0.6 μm in diameter, such as shown in FIG. 26(*c*) are arranged in parallel connection and forms an emitter array.

FIG. 1 is a perspective view showing the appearance of a field-emitter device. In FIG. 1, a gate electrode 12 is formed on a substrate 11 via an insulating layer (not shown in FIG. 1); and the above-mentioned emitter array 10 is formed in the center of the gate electrode 12. To the gate electrode 12 is connected a bonding pad 13 for application of gate voltage. The size of the device is ordinarily a square having a side of several millimeters (about 2 to 10 mm) when the device is used as electron sources such as electron tube or the like. Field-emitters are not produced each independently, but are produced by a wafer process such as used in the semiconductor industry and then divided into individual devices.

Figure 3:
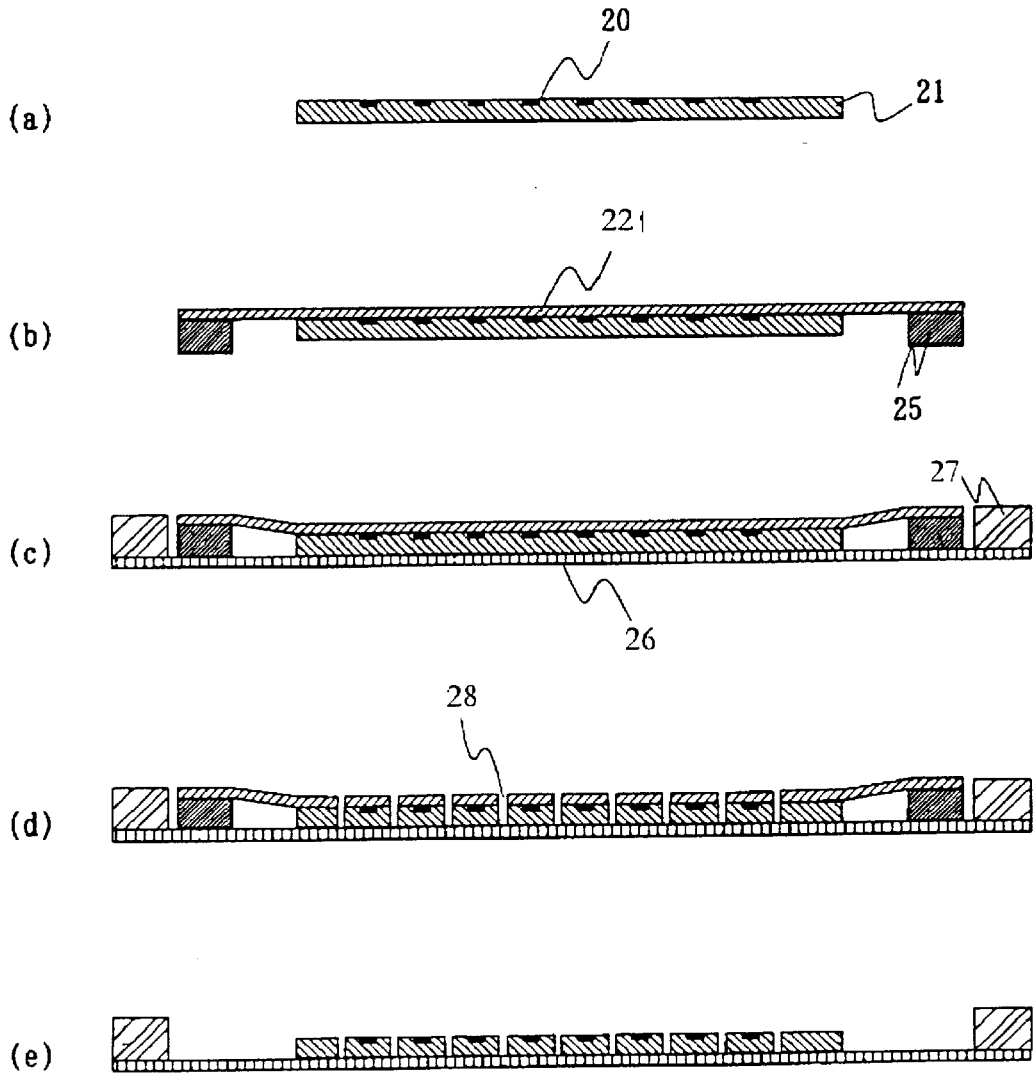
FIG. 3 is sectional views showing steps of the present process.

In this Example is described the ordinary operational process employed after wafer process, with reference to some of the accompanying drawings. FIG. 3(*a*) is a sectional view of a wafer 21 which has completed the wafer process. On the surface of the wafer 21 [the upper side of FIG. 3(*a*)] are arranged emitter areas 20 each containing an emitter array, in a matrix form. Since each emitter area is actually too small to identify, it is written in a much larger size in FIG. 3(*a*) to show its position.

A protective sheet 22 is applied on the surface of the wafer 21 in order to protect each emitter area 20 and each device surface from cutting water, sludge, etc. during dicing. The protective sheet 22 comprises (1) a base material made of a polyolefin, a polyethylene or the like and having a thickness of about 50 to 100 μm and (2) an adhesive layer made of an acrylic, a urethane adhesive or the like, formed on one side of the base material in the thickness of about 5 to 20 μm. In this Example, there is used an adhesive layer made of an UV-curing acrylic adhesive. For both the base material and the adhesive layer, it is desirable to use transparent materials for alignment conducted for dicing.

Figure 2:
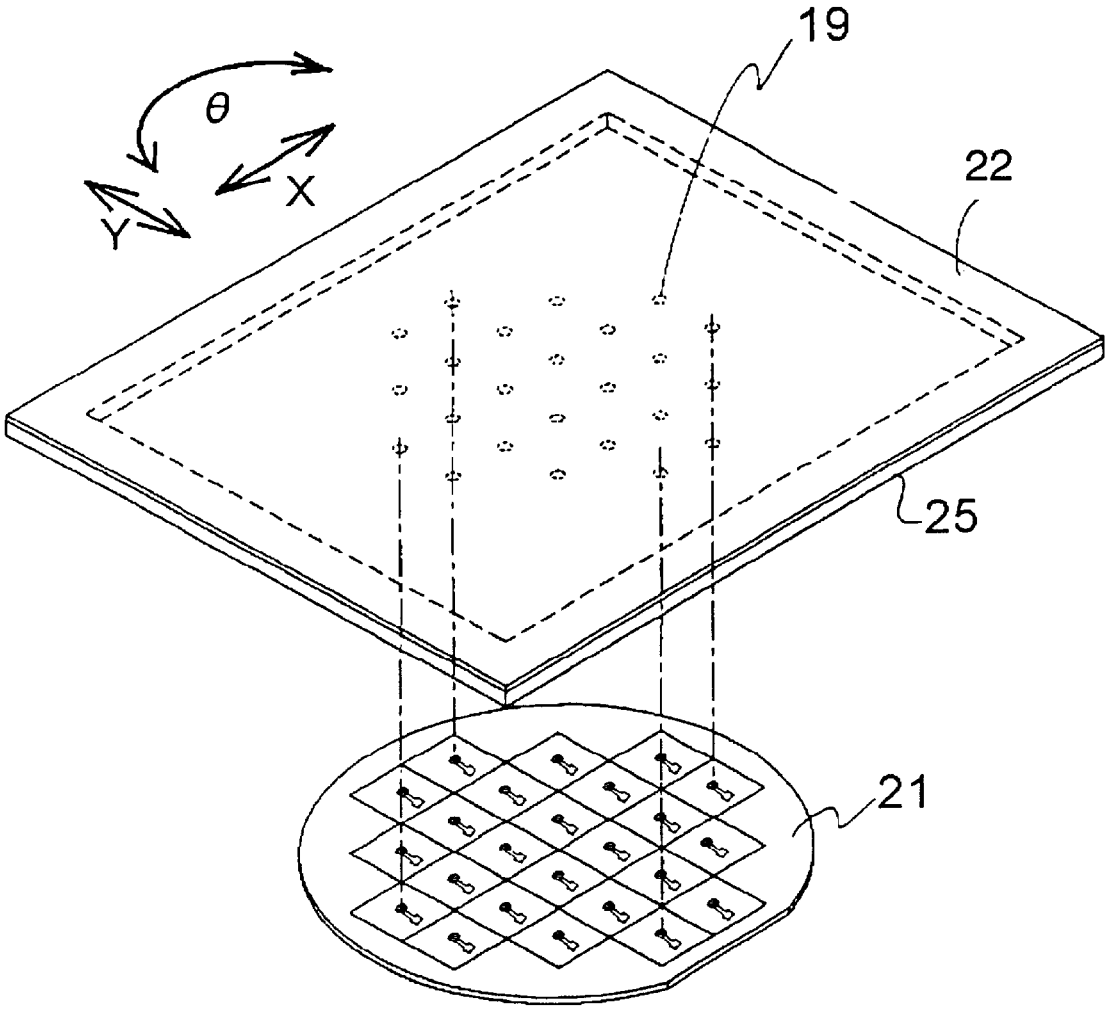
FIG. 2 is a perspective view showing an embodiment of the present process.
Figure 4:
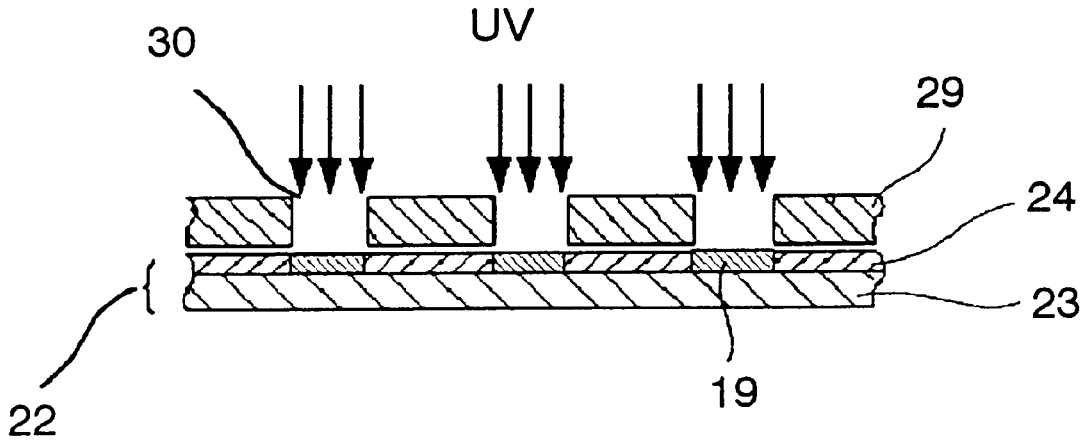
FIG. 4 is a schematic sectional view showing a method for forming protective areas (for each emitter area) in a protective sheet by UV application.
Figure 5:
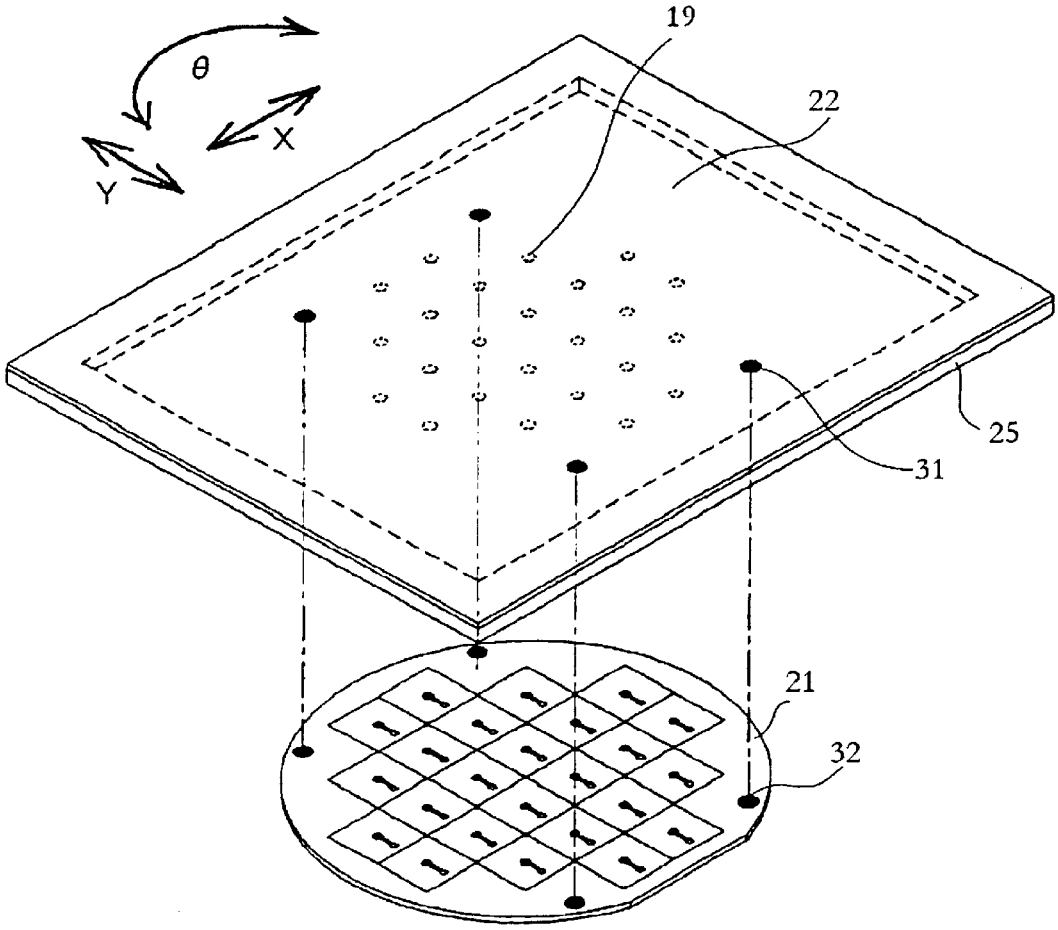
FIG. 5 is a perspective view showing an embodiment of the present process.

The protective sheet is fixed to a frame for protective sheet before its application onto a wafer. For example, the protective sheet 22 is stuck to a frame 25 for protective sheet, at the adhesive layer 24 side, as shown in FIG. 2. The position relationship between the protective sheet 22 and the frame 25 may be opposite to the above. In that case, an adhesive is beforehand coated on the area of the frame to contact with the base material 23 of the protective sheet 22, or the protective sheet 22 is fixed to the frame 25 by a mechanical means. In a state that the protective sheet 22 is fixed to the frame 25, only the areas of the protective sheet 22 corresponding to each emitter area are irradiated with an ultraviolet light. Specifically, as shown in FIG. 4, a mask 29 having apertures 30 of about the same size as each emitter area at the areas corresponding to each emitter area, is placed on or in close vicinity to the protective sheet 22; and an ultraviolet light is applied to the protective sheet 22 via the mask 29. As the mask 29, there can be used, for example, a mask obtained by forming, by etching, apertures 30 in a stainless steel sheet (a rolled foil) having a thickness of about 0.1 mm. The UV irradiation is conducted via the mask 29 by placing the mask 29 at the adhesive layer 24 side or base material 23 side of the protective sheet 22. As a result of the UV irradiation, the irradiated areas of the adhesive layer 24 are cured and become protective areas (cured areas) 19. Since it is difficult to distinguish the cured areas from the uncured areas, it is desirable to form aligning marks before or after or simultaneously with the UV application, as mentioned later.

As shown in FIG. 2, the application of the protective sheet onto a wafer is conducted by moving the frame 25 for protective sheet in X, Y and θ directions so that the emitter areas on the wafer 21 and the protective areas 19 formed in the protective sheet 22 can match with each other. In that case, any of the wafer and the frame 25 may be moved.

By forming the protective areas after the protective sheet has been fixed to the frame, there occurs no deformation of the protective sheet of low rigidity, the relative positions of the formed protective areas can be maintained, and the positioning of the protective sheet relative to the wafer can be conducted at a high accuracy. Further fixation of the protective sheet to the frame makes easy the handling of the protective sheet.

The material for the frame 25 can be any as long as it has a sufficient rigidity, and a metal, a plastic of high rigidity, etc. can be used. The shape of the frame 25 can be any as long as the above requirement of sufficient rigidity is satisfied, and any of rectangular shape (as shown in FIG. 2), circular shape, polygonal shape, elliptical shape and the like can be used. With respect to the thickness of the frame 25, a frame having a thickness larger than that of a wafer is used in FIG. 2; however, the thickness of frame may be about the same as the thickness of wafer, or may be smaller than the thickness of wafer as long as the frame has a sufficient rigidity.

As mentioned above, the positions of the protective areas (cured areas) 19 can be allowed to agree with the positions of the gate apertures of the devices of the wafer 21; therefore, there is no contact of the adhesive with the front end of each emitter electrode in the gate aperture. As a result of the alignment, the state of FIG. 3(*b*) is obtained.

Successively, onto the backside of the wafer 21 is applied a dicing sheet 26 which is necessary for holding of the wafer 21 during dicing and also for stretching of the wafer 21 after dicing. As the dicing sheet 26, there can be used, for example, a sheet obtained by forming an acrylic adhesive layer on a polyolefin base material, as in the case of the protective sheet 22. The dicing sheet 26, however, need not be an UV-curing type. When a ring-shaped frame 27 for dicing is fitted to the periphery of the wafer 21, the handling of the wafer 21 after the application of the dicing sheet 26 onto the wafer 21 becomes easier. By cutting and removing the unnecessary portion of the dicing sheet 26 outside the frame 27, a state of FIG. 3(*c*) is obtained. The position relationship between the frame 25 for protective sheet and the frame 27 for dicing is not restricted to that shown in FIG. 3(*c*). The frame 25 for protective sheet can function also as a frame for dicing and, in this case, no frame for dicing is necessary.

Figure 6:
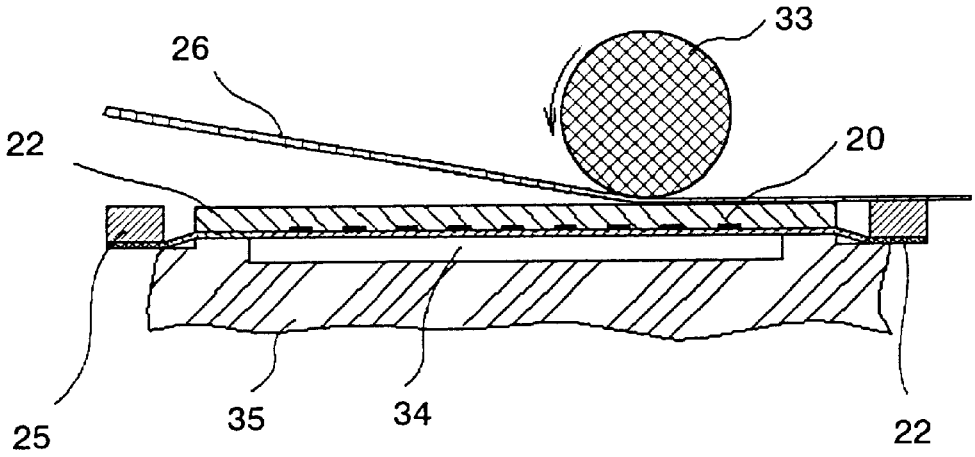
FIG. 6 is a schematic sectional view showing an example of the step of applying a dicing sheet on the back side of a wafer.

Application of the dicing sheet 26 onto the wafer 21 may be conducted, for example, by using a base 35 having a clearance 34 at least at the area contacting with the emitter areas 20, such as shown in FIG. 6 and applying a pressure by the use of a roller 33. This method of application is desirable because the protective sheet 22 receives no further pressure.

Figure 7:
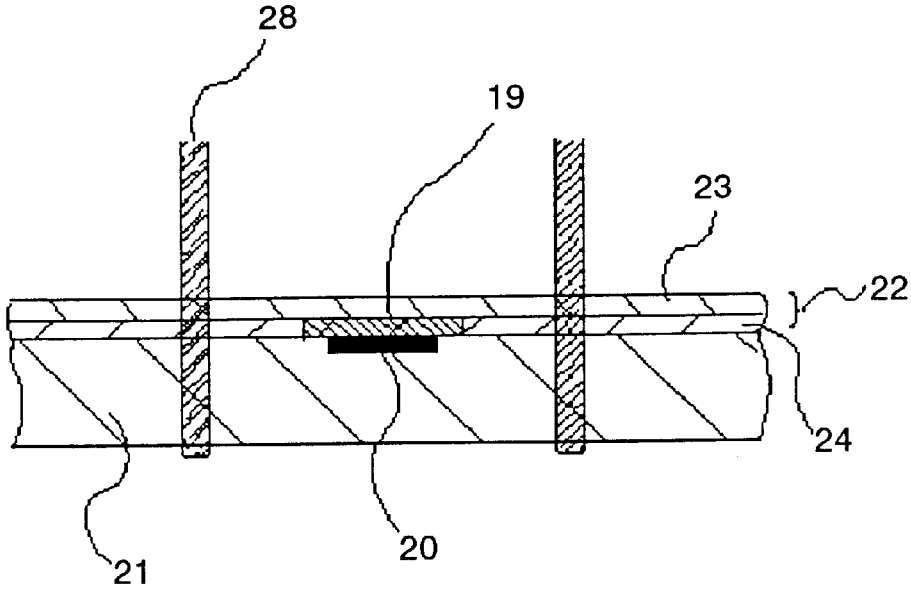
FIG. 7 is a schematic sectional view showing a protective sheet having protective areas (for each emitter area) formed by UV application and curing and a wafer portion of single cathode.
Figure 8:
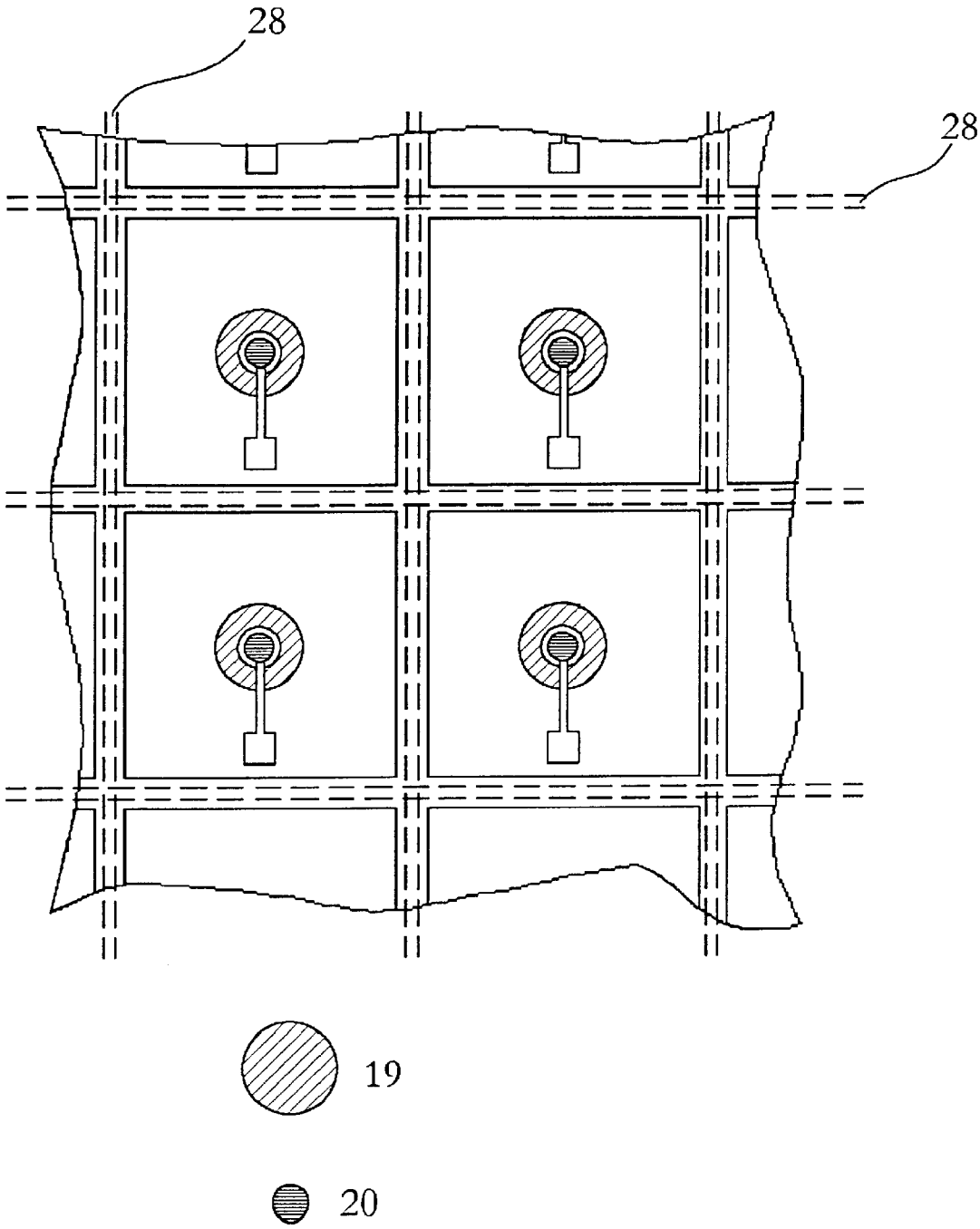
FIG. 8 is a plan view showing positions of dicing.

Next, dicing is conducted. Dicing is conducted in full cutting; that is, the protective sheet 22, the wafer 21 and the upper portion (about 20 μm) of the dicing sheet 26 are cut and the cut wafers 21 are separated from each other completely. Thereby, a state of FIG. 3(*d*) is obtained. The relation between each device and dicing positions is shown in FIG. 7 and FIG. 8. In the protective sheet 22, only the protective areas 19 corresponding to the emitter areas 20 are cured by irradiating UV light, are low in fluidity (deformability), and make no contact with the emitters; meanwhile, the protective areas 19 have low adhesivity to the wafer 21. However, the areas of the protective sheet 22 other than the protective areas 19 are adhered to the wafer 21 at an ordinary strength. In FIG. 8, the dicing positions 28 are shown by each two parallel broken lines between adjacent devices, and dicing is conducted at the areas where the protective sheet 22 and the wafer 21 are bonded at a sufficient strength. Therefore, the emitter areas 20 are protected from cutting water and sludge during dicing.

After dicing, the cutting water and sludge adhering on the protective sheet surface are removed by washing, followed by drying; an ultraviolet light is applied from the base material 23 side of the protective sheet 22 to lower the adhesivity of the adhesive layer 24 of the protective sheet 22; then, a release sheet obtained by coating an adhesive on a base material (a synthetic resin film) is applied onto the protective sheet, and the protective sheet 22 is peeled together with the release sheet by utilizing the adhesivity of the release sheet [FIG. 3(*e*)].

Figure 9:
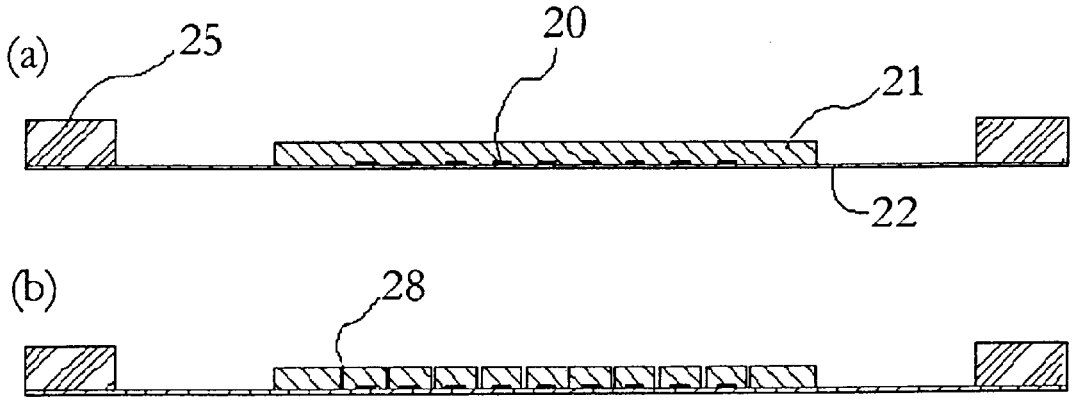
FIG. 9 is a schematic sectional view showing dicing from the backside of wafer.

In this Example, there was explained a case of applying a protective sheet 22 on the surface of a wafer 21 and a dicing sheet 26 on the backside of the wafer 21 and then conducting dicing from the surface side of the wafer. However, dicing from the backside of a wafer, such as shown in FIG. 9, is possible. In this case, it is possible to set standard points beforehand at the periphery of the wafer 21 and decide dicing positions based on the standard points, or, in the case of a silicon wafer, to conduct positioning by the use of a transmitted light (an infrared light).

Figure 10:
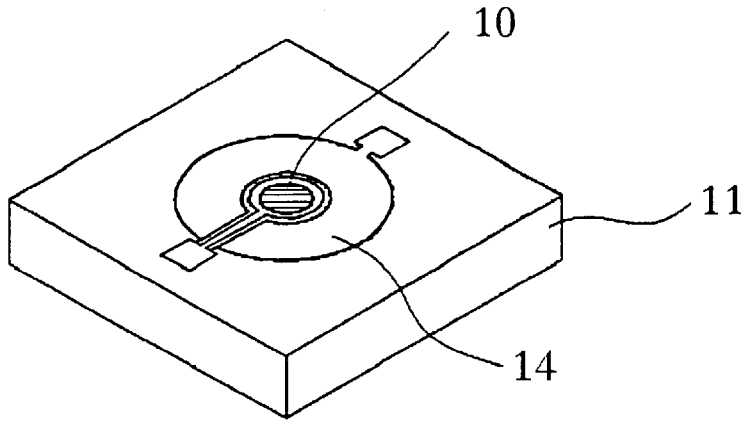
FIG. 10 is perspective views showing other examples of the field-emitters obtainable by the present process.
Figure 10:
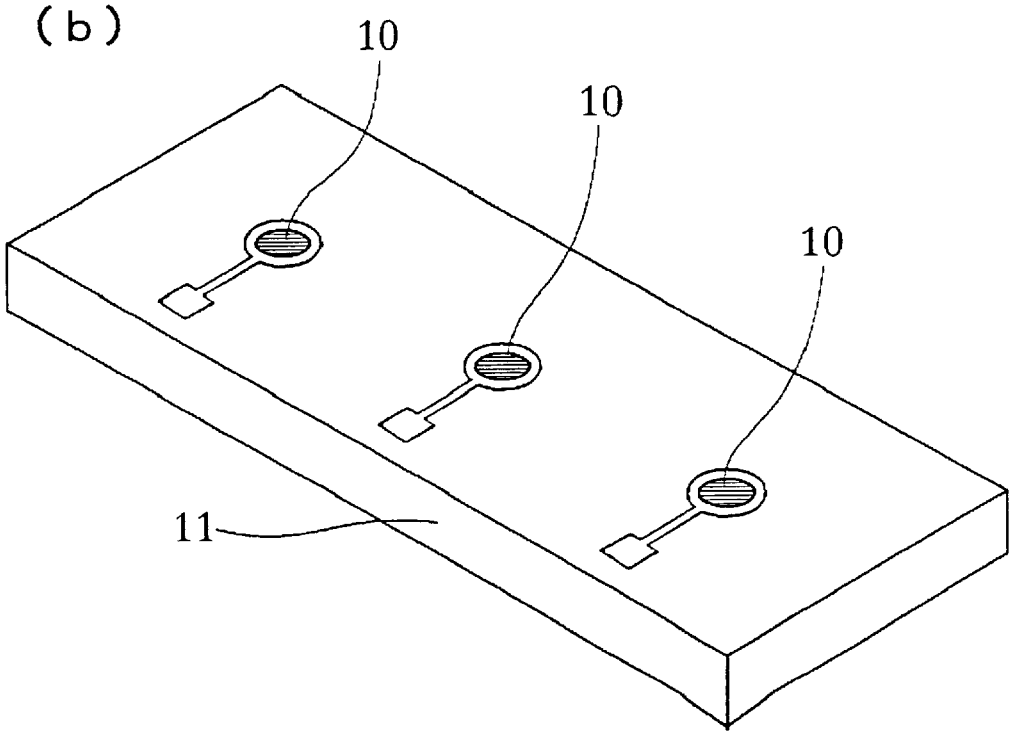

In this Example was explained a case of producing a device as shown in FIG. 1, i.e. a device containing one emitter array. However, this Example is also applicable to a case of producing a device such as shown in FIG. 10(*a*), i.e. a device having a focussing electrode 14 for converging electron beams, at the periphery of a gate electrode; in this case, the protective areas 19 of protective sheet can be formed so as to correspond to each emitter array 10. This Example is further applicable to a case of producing a device such as shown in FIG. 10(*b*), i.e. a device containing a plurality of emitter arrays 10; in this case, one protective area 19 may be formed so as to correspond to one emitter array 10, or one protective area may be formed so as to cover a plurality of emitter arrays 10.

Figure 25:
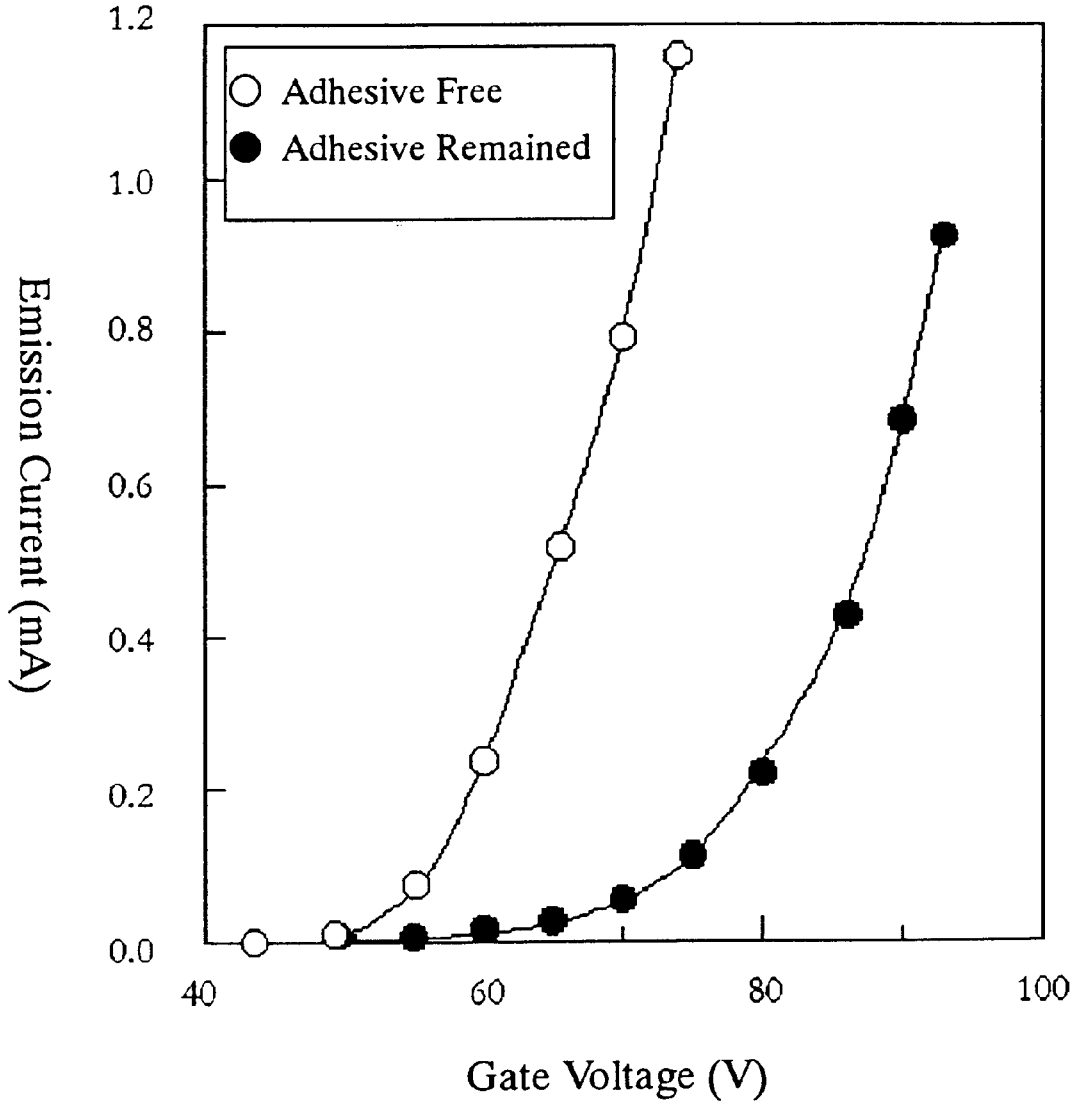
FIG. 25 is a graph showing the effect of adhesive on emitter property.

In this Example, the areas of the adhesive layer of protective sheet corresponding to the emitter areas of wafer are cured by UV irradiation, prior to the application of the protective sheet onto the wafer; thereby, the deformation (flow) of adhesive during the application of the protective sheet onto the wafer is suppressed, the amount of the adhesive penetrating into gate aperture is minimized, and there is no contact of adhesive with emitter. As a result, there is no remaining of adhesive on emitter surface and an excellent emission property (a curve containing o marks, in FIG. 25) is obtained. In the above was described a case where aligning marks are formed on both the protective sheet and the wafer, and application of the protective sheet onto the wafer is conducted utilizing the aligning marks. Below is described a case where said application is conducted easily at a high aligning accuracy.

Figure 11:
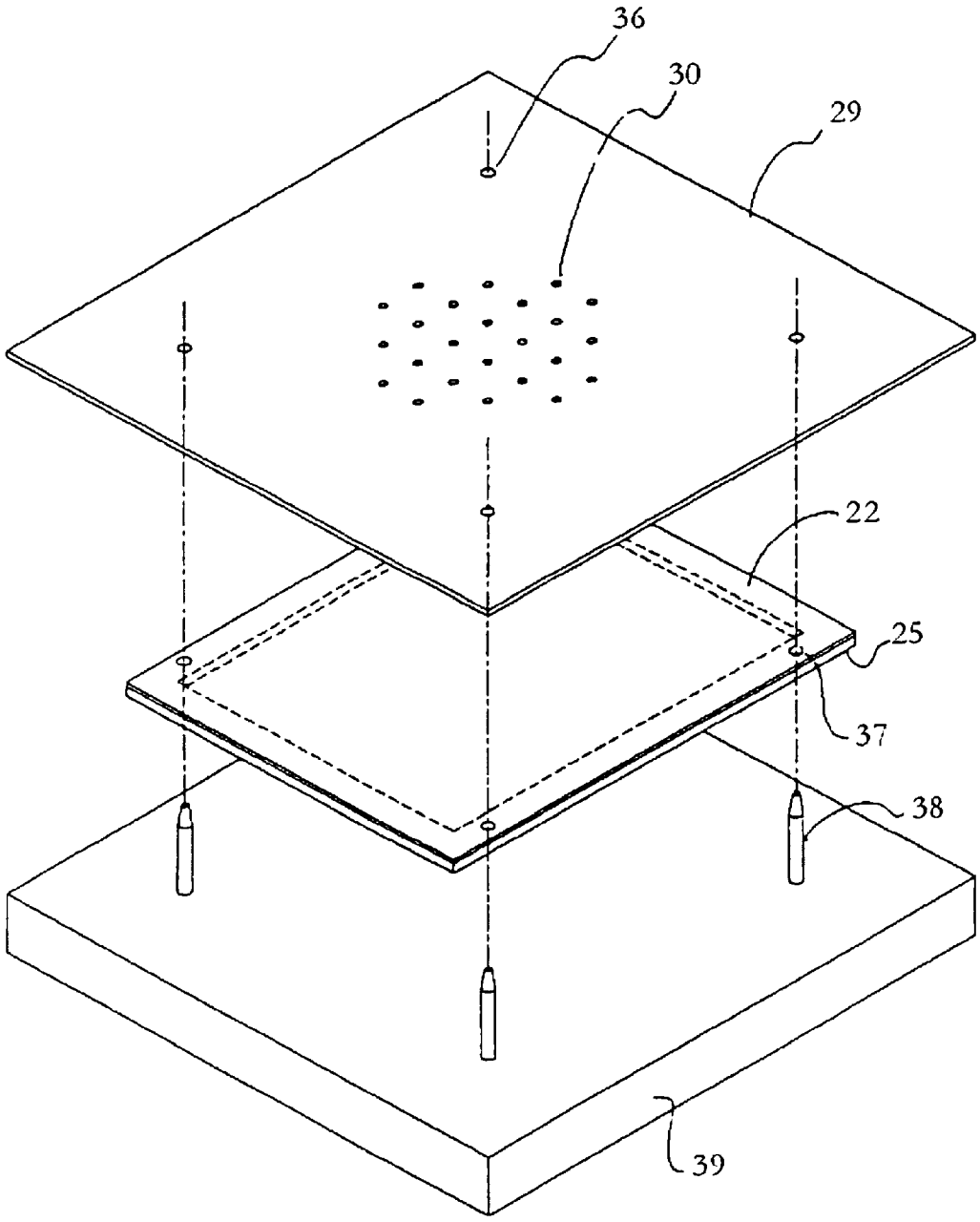
FIG. 11 is a perspective view showing an embodiment of the present process, wherein alignment is conducted by an improved method.

As shown in FIG. 11, when UV application is made, via a metal mask 29, onto a protective sheet 22 fixed to a frame 25 for protective sheet, to form protective areas at the surface of the protective sheet 22, aligning holes 37 and 36 are beforehand formed in the frame 25 and the metal mask 29, respectively; the aligning pins 38 of a jig 39 are inserted into the holes 37 and 36; and UV irradiation is conducted in that state. This is a case where UV irradiation is made only to part of the adhesive layer of protective sheet to form protective areas at the protective sheet surface, and this practice is applicable also to later Examples. In the above, the jig 39 having registration pins 38 was used. Alternatively, aligning pins may be formed in the frame 25 or the mask 29, and holes corresponding to the pins may be formed in the mask 29 or the frame 25; or, based on outer side of frame 25, base means to which the jig 39 is applied are formed. It is advisable to form aligning means so that they can be used up to when the protective sheet is applied onto a wafer.

Figure 12:
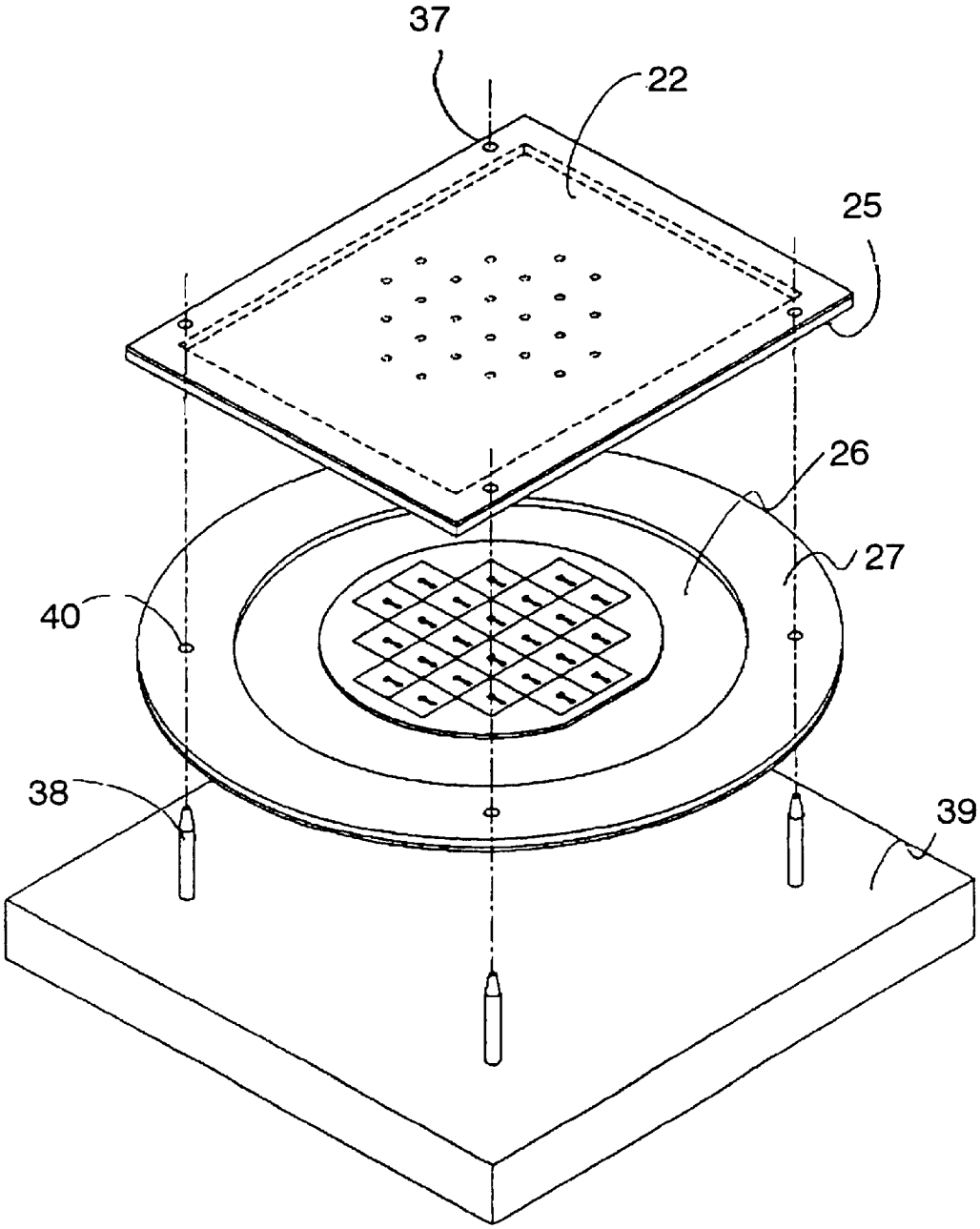
FIG. 12 is a perspective view showing an embodiment of the present process, and explains the step of the application of protective sheet onto wafer conducted after the operation of FIG. 11.

Next, the protective sheet 22 is applied onto a wafer 21. As shown in FIG. 12, alignment is conducted by inserting the aligning pins 38 of a jig 39 into the aligning holes 40 of a frame 27 attached to a dicing sheet 26 holding a wafer 21 and also into the aligning holes 37 of a frame 25 fixed to a protective sheet 22 having protective areas formed at the surface; thereby, the emitter areas of the wafer 21 and the protective areas of the protective sheet 22 are matched with each other, and application of protective sheet onto wafer is conducted.

Thus, by using the same aligning means in formation of protective areas and in application of protective sheet onto wafer, alignment can be made more simply and more accurately.

EXAMPLE 2

In this Example is described a case wherein application of protective sheet onto wafer is conducted after a deposition film made of a metal, a ceramic or the like is formed or a shaped foil obtained by cutting or punching is applied, on each area of the adhesive layer of protective sheet corresponding to each emitter area of devices formed at wafer surface.

The material for the deposition film or the foil is not restricted to a metal and can be any material as long as it has rigidity higher than that of the adhesive of adhesive layer and can suppress the flow of the adhesive.

Example 2 is described with reference to some of the accompanying drawings. Here, the description which is common to Example 1, is not repeated, and description is made mainly on the step of forming a metal film (or applying a metal foil) on a protective sheet to use it as each protective area.

As the protective sheet, there is used a sheet similar to that used in Example 1, obtained by coating an adhesive of acrylic type, urethane type or the like in a thickness of about 5 to 20 μm, on one side of a base material made of a polyolefin, a polyethylene or the like, having a thickness of about 50 to 100 μm. The protective sheet is fixed to a frame, as in Example 1.

On each area of the adhesive layer of the protective sheet corresponding to each emitter area of devices of wafer is applied or formed a foil or a thin film each made of a metal, a ceramic or the like.

Figure 14:
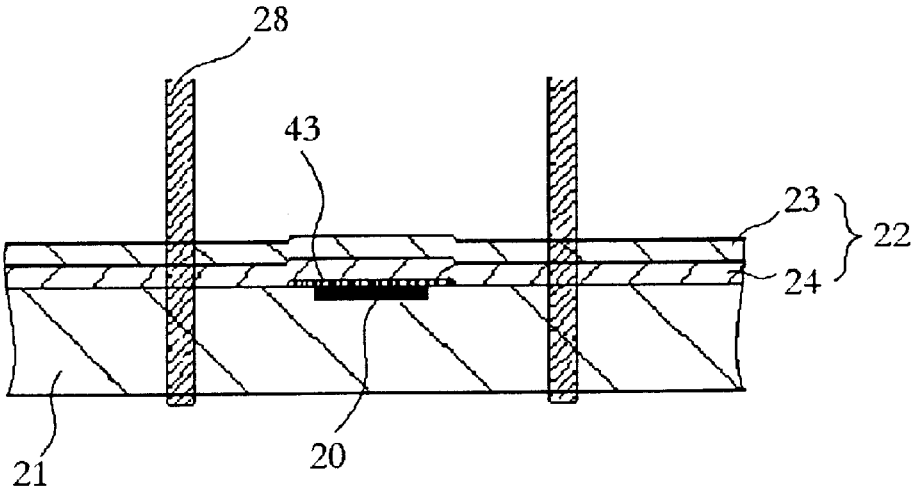
FIG. 14 is a schematic sectional view showing a protective sheet having protective areas (for each emitter area) formed in the form of thin films and a wafer portion of single cathode.

A case of applying a metal foil is described. As shown in FIG. 2, on each protective area 19 of a protective sheet 22 is applied a metal foil of the same size as the protective area 19. As the material for the metal foil, there can be used many kinds of materials having rigidity higher than that of the adhesive used in the adhesive layer of the protective sheet 22. Here, the same material as used in the emitter is used in considering the effect on emitter surface as important and, in the case of Spindt type shown in FIG. 26, molybdenum is used as the metal foil material. The size of foil is about 0.2 to 0.5 in diameter when the size of device is 2 mm×2 mm and the emitter area is 0.1 mm in diameter; and the thickness of foil is about several 1m in view of the handling of the foil. The material for foil can be not only a metal but also a glass, a ceramic, etc. The size of foil is not restricted to the above-mentioned size and can be, as shown in FIG. 14, such that the foil covers an emitter area 20 and a sufficient bonded area between protective sheet and wafer is secured from one end of the foil to a dicing position 28. The shape of foil is a circle in FIG. 2 but can also be a rectangular shape, a polygonal shape, an elliptical shape or the like as long as the above-mentioned requirement is satisfied.

Figure 13:
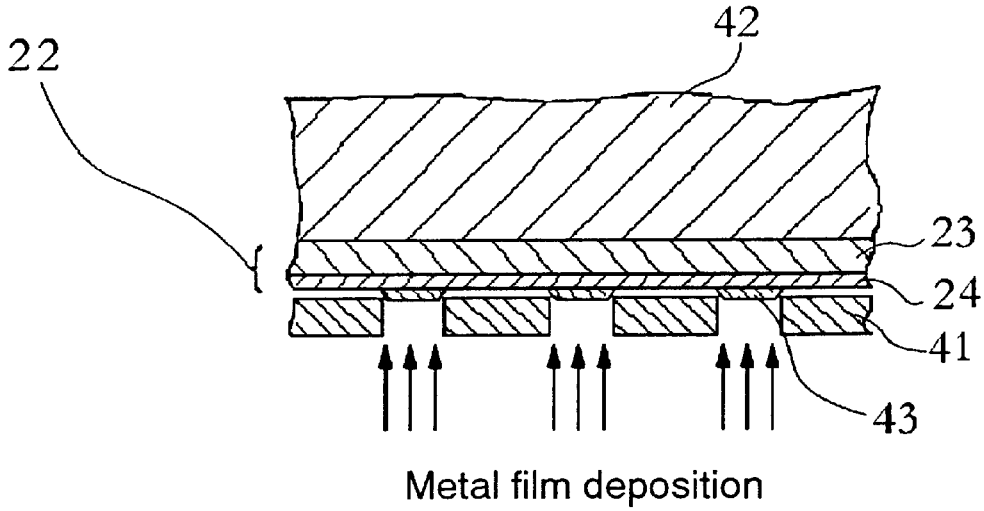
FIG. 13 is a schematic sectional view showing a case of forming, on a protective sheet, protective areas (for each emitter area) in the form of thin films, by deposition.

Then, a case of forming a deposition film is described. As shown in FIG. 13, a protective sheet 22 is placed in a deposition apparatus (not shown in FIG. 13); a mask 41 is aligned in front of the adhesive layer 24 of the protective sheet 22 with a gap of several millimeters provided to the adhesive layer 24. As the mask 41, there can be a stainless steel sheet (a rolled foil) of about 0.1 mm in thickness, having apertures of diameter of about 2 to 5 times that of emitter area at the same intervals as the emitter. The base material 23 side of the protective sheet 22 is adhered to a cooled holder 42, whereby temperature rise during deposition film formation is prevented. In this state, aluminum, for example, is vacuum-deposited in a thickness of 0.1 to 1 $\mu$m, whereby a thin film 43 to become a protective area 19 is formed.

The protective sheet having protective areas formed as above is applied onto a wafer 21 in the same manner as in Example 1, as shown in FIG. 3. At that time, since each protective area of the protective sheet, formed by a foil or a thin film 43 is visible, marking on protective sheet as conducted in Example 1 is not essential.

FIG. 14 shows a schematic sectional view of a protective sheet 22 and a wafer portion of single device. Penetration of the adhesive layer 24 of the protective sheet 22 into each gate aperture is prevented by a thin film 43 (or a foil), and there is no contact of the adhesive layer 24 with each emitter front end.

After dicing, peeling of protective sheet is conducted by UV irradiation and the use of release sheet, as in Example 1. In this Example as well, dicing from the backside of wafer 21 as shown in FIG. 9 is possible. Correspondence between each emitter area and each protective area is the same as in Example 1.

In this Example, prior to application of protective sheet onto wafer, on each area of the adhesive layer of protective sheet corresponding to each emitter area is applied or formed a foil or a thin film each having rigidity higher than that of the adhesive layer; thereby, deformation (flow) of the adhesive of adhesive layer during application of protective sheet onto wafer is prevented. There is no penetration of adhesive into gate aperture, and there is no contact of adhesive with emitter. As a result, there is no remaining of adhesive on emitter surface and an excellent emitter property is obtained. Further, since the foils applied or the thin films formed are readily visible, alignment can be conducted easily.

EXAMPLE 3

In this Example is described a case wherein application of protective sheet onto wafer is conducted after adhesive-free areas have been formed at the areas of protective sheet corresponding to the emitter areas of devices of wafer, by coating no adhesive on said areas of protective sheet or by removing the adhesive coated on the whole surface of protective sheet, only at said areas of protective sheet.

Example 3 is described with reference to some of the accompanying drawings. Here, the description which is common to Example 1, is not repeated. As the protective sheet, there is used a sheet similar to that used in Example 1, obtained by coating an adhesive of acrylic type, urethane type or the like in a thickness of about 5 to 20 $\mu$m, on one side of a base material made of a polyolefin, a polyethylene or the like, having a thickness of about 50 to 100 $\mu$m.

Figure 15:
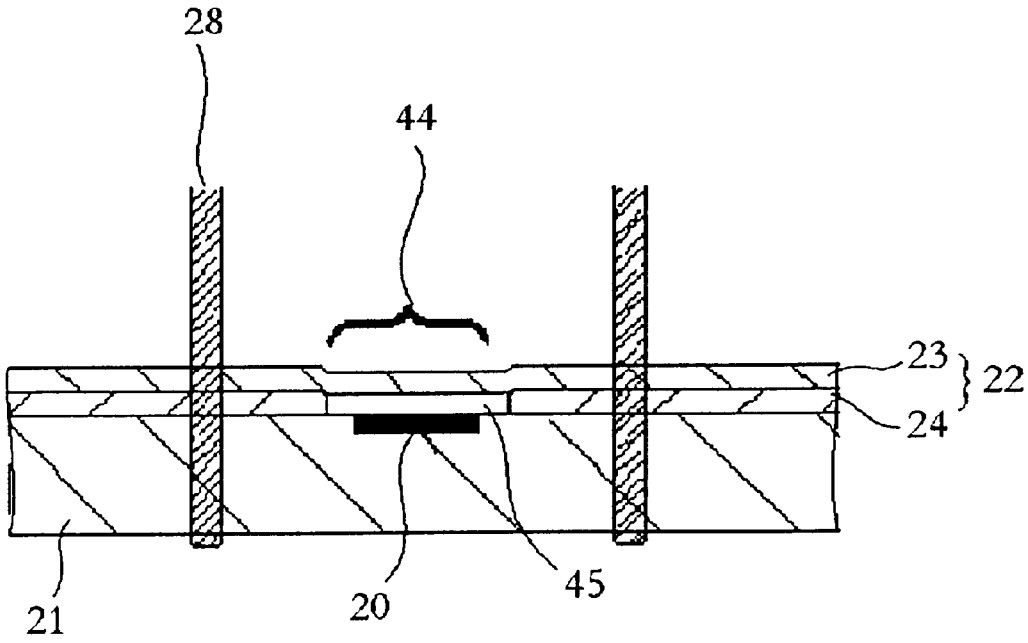
FIG. 15 is a schematic sectional view showing a protective sheet having protective areas (for each emitter area) formed in the form of adhesive-free areas and a wafer portion of single cathode.

As shown in FIG. 15, at the areas (the protective areas in FIG. 2) of a protective sheet 22 corresponding to the emitter areas of the devices of a wafer 21 are formed adhesive-free areas 44, by coating no adhesive on said areas of the protective sheet 22 or by removing the adhesive coated on the whole surface of the protective sheet 22, only at said areas of the protective sheet 22. The size of each adhesive-free area 44 is about 0.2 to 0.5 in diameter when the size of each device is 2 mm×2 mm and the emitter area is 0.1 mm in diameter. The size is not restricted to the above-mentioned size and can be, as shown in FIG. 15, such that each adhesive-free area 44 covers an emitter area 20 and a sufficient bonded area between protective sheet and wafer is secured from one end of the adhesive-free area 44 to a dicing position 28. The shape of adhesive-free area is a circle in FIG. 15 but can also be a rectangular shape, a polygonal shape, an elliptical shape or the like as long as the above-mentioned requirement is satisfied.

The protective sheet having protective areas formed as above is applied onto a wafer 21 in the same manner as in Example 1, as shown in FIG. 3. At that time, since each adhesive-free area 44 of the protective sheet is visible, marking on protective sheet as conducted in Example 1 is not essential.

The thickness of the protective sheet at the adhesive-free area 44 is smaller than that of all other areas of the protective sheet by the thickness of the adhesive layer 24 of the protective sheet. Owing to this difference of thickness, a gap 45 is formed on each emitter area 20. Since there is no adhesive at the adhesive-free area 44, there is no case any adhesive contacts with the emitter front end.

After dicing, peeling of protective sheet is conducted by UV application and the use of release sheet, as in Example 1. In this Example as well, dicing from the backside of wafer 21 as shown in FIG. 9 is possible. Correspondence between each emitter area and each protective area is the same as in Example 1.

In this Example, at the time of application of protective sheet onto wafer, the protective sheet has no adhesive at the areas corresponding to the emitter areas. Therefore, there is no penetration of adhesive into gate aperture, and the thickness difference caused by no adhesive creates a gap on each emitter. There is no remaining of adhesive on emitter surface, and an excellent emission property can be obtained.

EXAMPLE 4

In this Example is described a case wherein application of protective sheet onto wafer is conducted after a tool having convex parts is applied, under pressure, onto the areas of the adhesive layer of a protective sheet corresponding to the emitter areas of the devices of a wafer, to form concave at said areas of the adhesive layer.

Example 4 is described with reference to some of the accompanying drawings. Here, the description which is common to Example 1, is not repeated. As the protective sheet, there is used a sheet similar to that used in Example 1, obtained by coating an adhesive of acrylic type, urethane type or the like in a thickness of about 5 to 20 μm, on one side of a base material made of a polyolefin, a polyethylene or the like, having a thickness of about 50 to 100 μm.

Figure 16:
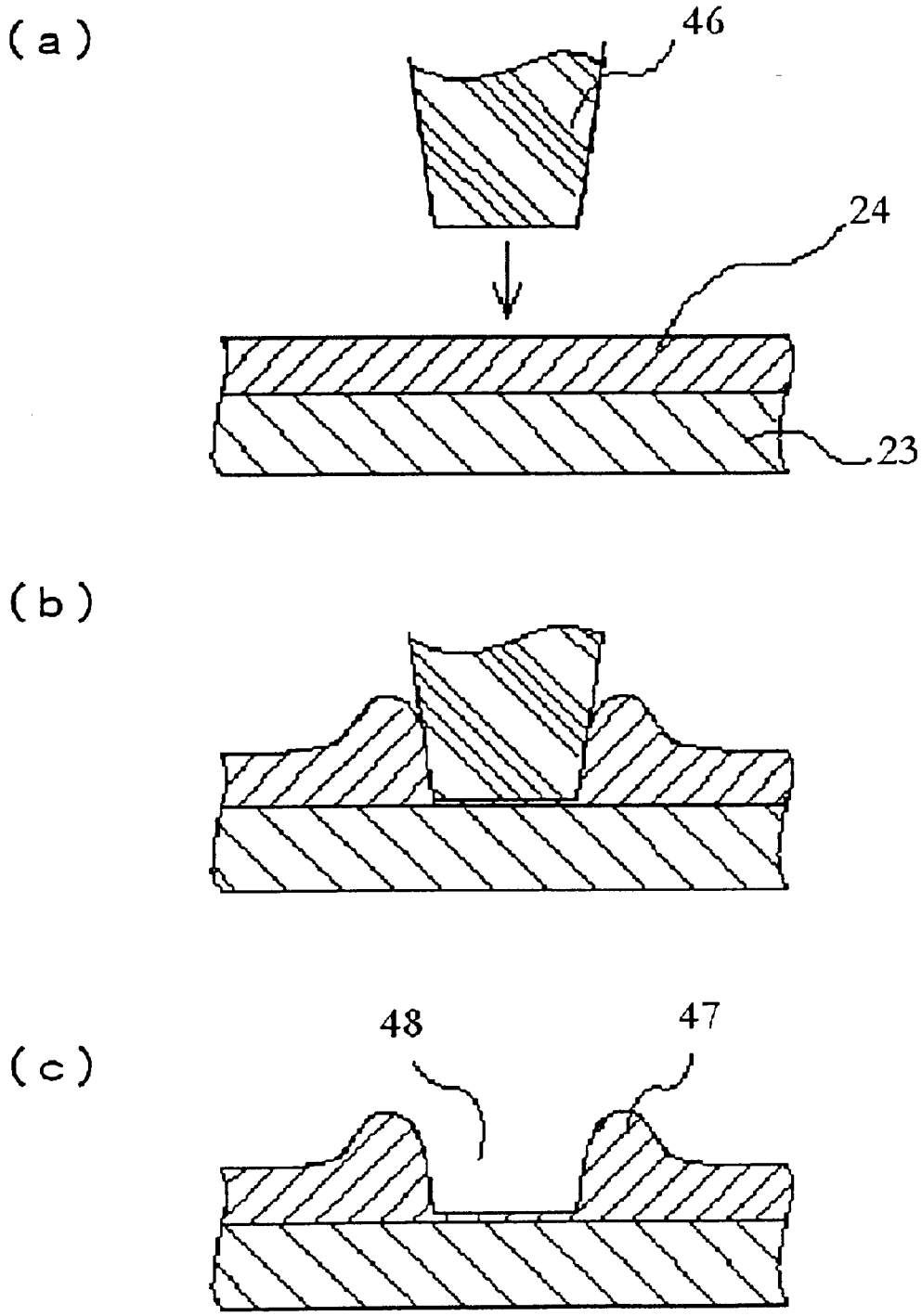
FIG. 16 is schematic sectional views showing steps of forming concave areas in the adhesive layer of the protective sheet by pressing a convex tool against the adhesive layer.

As shown in FIG. 16(*a*), a convex part 46 (e.g. a roller) having convex parts at the areas corresponding to the emitter areas of wafer is rolled on a protective sheet under pressure, whereby concave areas 48 as shown in FIG. 16(*c*) are formed in the adhesive layer of the protective sheet. Here, a roller is used, but a flat convex part 46 having convex parts at the surface may also be used. It is also possible to use a convex part 46 having a single convex part; in that case, the tool 46 is pressed upon a protective sheet repeatedly by changing the position. Desirably, the tool 46 is made of a material which is not easily adhered to the adhesive layer of protective sheet, such as fluororesin (e.g. Teflon®), or is made of a different material coated with a material which is not easily adhered to the adhesive layer. By employing one of the above-mentioned methods, concave areas 48 and burrs 47 are formed at the adhesive layer 24 of protective sheet, according to the steps (a) to (c) of FIG. 16.

The size of each concave area 48 is about 0.2 to 0.5 in diameter when the size of device is 2 mm×2 mm and the emitter area is 0.1 mm in diameter. The depth at which the tool is pushed into the adhesive layer, is, for example, about 1 to 20 μm, but must be varied depending upon the thickness of the adhesive layer of protective sheet. The size of concave area 48 is not restricted to the above-mentioned size and can be such that each concave area 48 covers an emitter area 20 and a sufficient bonded area between protective sheet and wafer is secured from one end of the concave area 48 to a dicing position 28. The shape of concave area 48 can be a rectangular shape, a circular shape, a polygonal shape, an elliptical shape or the like as long as the above-mentioned requirement is satisfied.

The protective sheet having protective areas formed as above is applied onto a wafer 21 in the same manner as in Example 1, as shown in FIG. 3. At that time, since each concave area 48 of the protective sheet is visible, marking on protective sheet as conducted in Example 1 is not essential.

Figure 17:
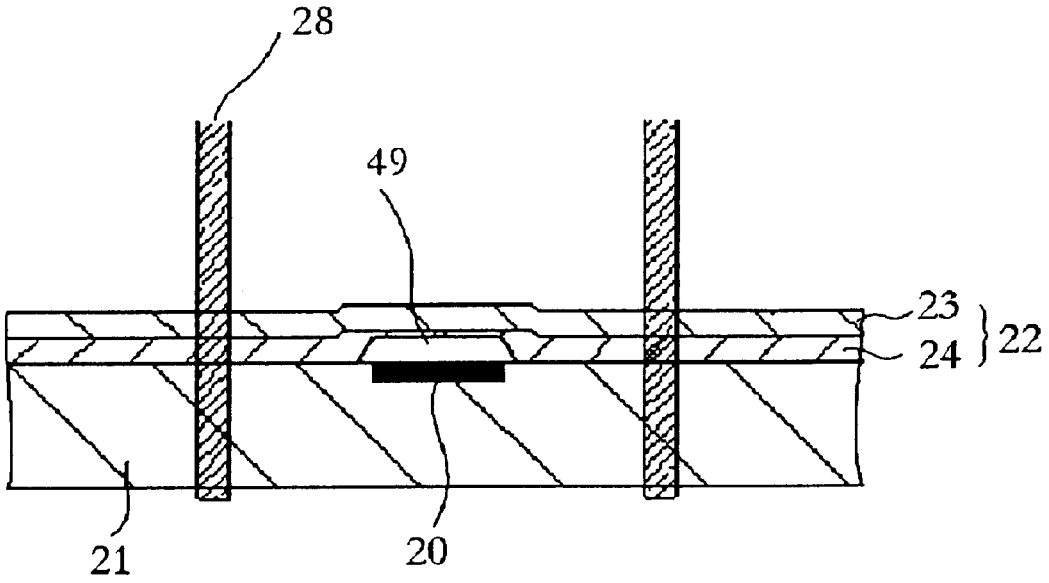
FIG. 17 is a schematic sectional view showing a protective sheet having protective areas (for each emitter area) formed in the form of concave areas by pressing a convex tool against the adhesive layer of the protective sheet and a wafer portion of single cathode.

FIG. 17 shows a schematic sectional view of a protective sheet 22 and a wafer 21 portion of single device. At the concave areas 48, a level difference is generated by the dent and burr 47 of the adhesive layer 24 and, as a result, a gap 49 is formed on the emitter area 20. Therefore, there is no contact of the adhesive layer with the emitter front end.

After dicing, peeling of protective sheet is conducted by UV irradiation and the use of release sheet, as in Example 1. In this Example as well, dicing from the backside of wafer 21 as shown in FIG. 9 is possible. Correspondence between each emitter area and each protective area is the same as in Example 1.

In this Example, when a protective sheet has been applied onto a wafer, a gap 49 is formed on the emitter area of the wafer owing to the level difference generated in the concave area 48 of the adhesive layer by the dent and burr 47; as a result, there is no penetration of adhesive into gate aperture. Further, there is no remaining of adhesive on emitter surface, and an excellent emission property is obtained.

EXAMPLE 5

In this Example is described a case wherein application of protective sheet onto wafer is conducted by applying under pressure, onto a protective sheet, a pressing tool having concave parts at the areas corresponding to the emitter areas of the devices of a wafer on which the protective sheet is to be applied.

Example 5 is described with reference to some of the accompanying drawings. Here, the description which is common to Example 1, is not repeated. As the protective sheet, there is used a sheet similar to that used in Example 1, obtained by coating an adhesive of acrylic type, urethane type or the like in a thickness of about 5 to 20 μm, on one side of a base material made of a polyolefin, a polyethylene or the like, having a thickness of about 50 to 100 μm. In the process of this Example, it is not necessary to fix the protective sheet to a frame.

Figure 18:
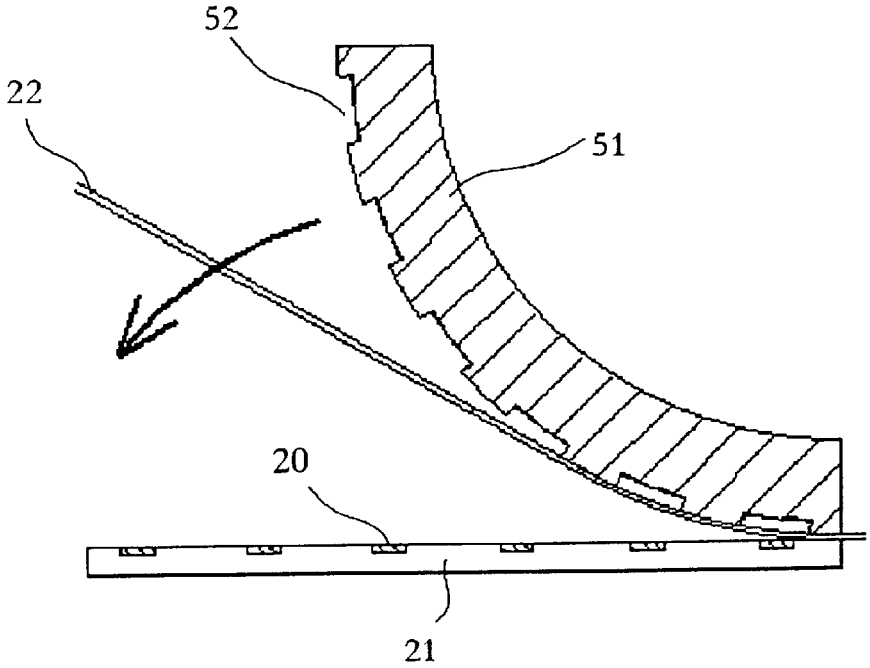
FIG. 18 is a sectional view showing an embodiment of the second process of the present invention.

As shown in FIG. 18, a protective sheet 22 is applied onto a wafer 21 by using a pressing tool 51 having concave parts 52. The concave parts 52 are provided at the surface areas of the pressing tool 51 corresponding to the emitter areas 20 of a wafer 21 on which the pressing tool 51 is to be rolled via the protective sheet 22. By using the pressing tool 51 having concave parts 52, the protective sheet 22 is applied onto the wafer 21 under pressure, starting from one end of the wafer, as shown in FIG. 18. At that time, the wafer 21 must be disposed so as to correspond to the track of the pressing tool 51 having concave parts 52. Meanwhile, the protective sheet 22 need not have accurate alignment with any of the wafer 21 and the pressing tool 51 having concave parts 52.

Figure 19:
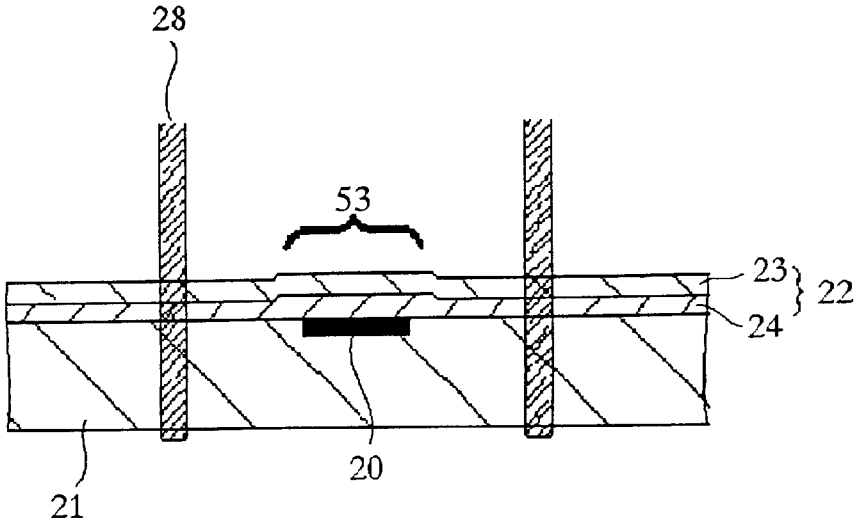
FIG. 19 is a schematic sectional view showing a protective sheet having protective areas (for each emitter area) formed by the method of FIG. 18 and a wafer portion of single cathode.

FIG. 19 shows a schematic sectional view of a protective sheet 22 and a wafer 21 portion of single device. When a pressing tool 51 having concave parts 52 is rolled on a protective sheet 22 to apply the protective sheet 22 onto a wafer 21, there is substantially no deformation of the adhesive layer 24 of the protective sheet 22, at the area of the protective sheet 22 corresponding to the concave part 52, i.e. the pressure-reduced area 53 of the protective sheet 22 corresponding to the emitter area 20. Therefore, there is substantially no penetration of adhesive into gate aperture, and contact between emitter and adhesive layer can be prevented.

The size of concave part 52 is about 0.2 to 0.5 mm in diameter when the size of device is 2 mm×2 mm and the emitter area is 0.1 mm in diameter. The depth of concave part 52 is about 0.1 to 1 mm, but must be varied depending upon the thickness of the base material and adhesive layer of the protective sheet. The size of concave part 52 is not restricted to the above-mentioned size and can be such that the pressure-reduced area 53 has an appropriately reduced pressure and a sufficient bonded area between protective sheet and wafer is secured from one end of the pressure-reduced area 53 to a dicing position 28. The shape of concave part 52 can be a rectangular shape, a circular shape, a polygonal shape, an elliptical shape or the like as long as the above-mentioned requirement is satisfied.

FIG. 18 is a case of using a pressing tool 51 with concave parts 52, having an arc-shaped section. The pressing tool may be a column-shaped roller having concave parts at the surface.

After dicing, peeling of protective sheet is conducted by UV application and the use of release sheet, as in Example 1. In this Example as well, dicing from the backside of wafer 21 as shown in FIG. 9 is possible. Correspondence between each emitter area and each protective area is the same as in Example 1.

In this Example, the concave parts 52 of pressing tool 51 (corresponding to the emitter areas 20 via the protective sheet 22) do not press the protective sheet 22; therefore, there is substantially no deformation of adhesive layer 24 at the pressure-free areas of the protective sheet 22 corresponding to the emitter areas 20. Therefore, there is substantially no penetration of adhesive into gate aperture, and contact between emitter and adhesive layer can be prevented. There is no remaining of adhesive on emitter surface, and an excellent emission property can be obtained. Further, as long as the concave part 52 of pressing tool 51 and the emitter area 20 have position correspondence with each other, independently of the expansion or contraction of the protective sheet, the positioning of the protective sheet is not necessary.

EXAMPLE 6

In this Example is described a case wherein application of protective sheet onto wafer is conducted by (1) applying under pressure, onto a protective sheet, a pressing tool having concave parts at the areas corresponding to the emitter areas of the devices of a wafer on which the protective sheet is to be applied (the operation up to this point is the same as in Example 5) and (2) evacuating the concave parts of the pressing tool by the use of a vacuum pump to deform the protective sheet and allow the protective sheet to have concave areas covering the emitter areas.

Example 6 is described with reference to some of the accompanying drawings. Here, the description which is common to Example 5, is not repeated. As the protective sheet, there is used a sheet similar to that used in Example 1, obtained by coating an adhesive of acrylic type, urethane type or the like in a thickness of about 5 to 20 $\mu$m, on one side of a base material made of a polyolefin, a polyethylene or the like, having a thickness of about 50 to 100 $\mu$m.

Figure 20:
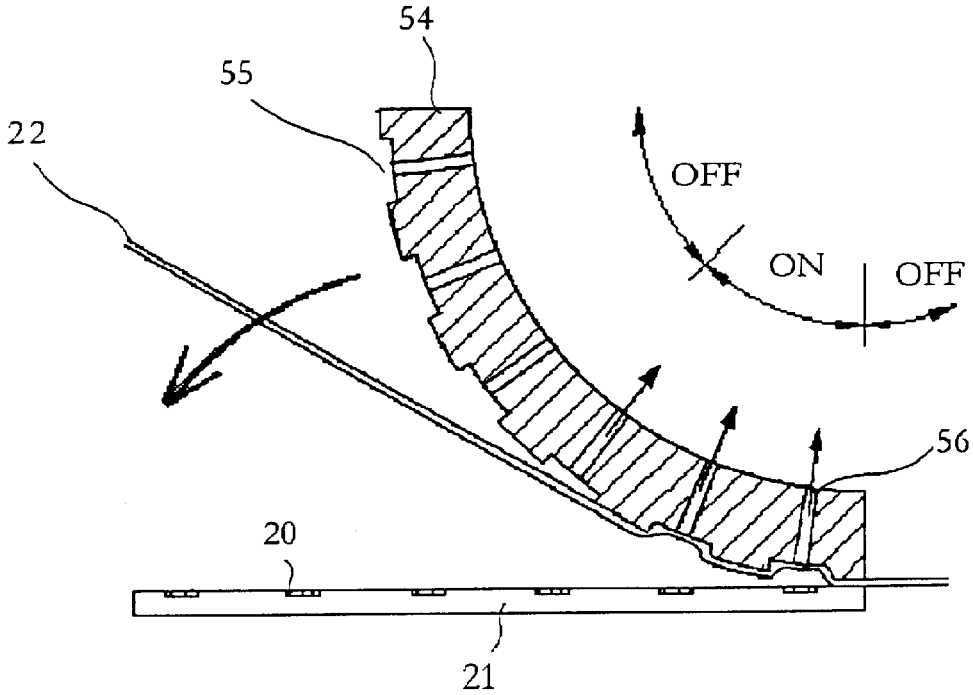
FIG. 20 is a sectional view showing other embodiment of the second process of the present invention.

As shown in FIG. 20, a protective sheet 22 is applied onto a wafer 21 by using a pressing tool 54 having concave parts 55. The concave parts 55 of the pressing tool 54 are provided at the surface areas of the pressing tool 54 corresponding to the emitter areas 20 of a wafer on which the pressing tool 54 is to be rolled via the protective sheet 22. The concave parts 55 each have a suction hole 56 at the bottom, and this suction hole 56 is connected to a vacuum pump or an evacuator (not shown in FIG. 20). By using the pressing tool 54 having concave parts 55, the protective sheet 22 is applied onto the wafer 21 under pressure, starting from one end of the wafer, as shown in FIG. 20. At this time, the suction hole 56 is connected with the vacuum pump only for a period from the moment one end of the concave part 55 contacts with the protection sheet 22 to the moment the other end of the concave part 55 separates from the protective sheet 22 which is adhered to the wafer 21 (e.g. an ON region in FIG. 20). During the period the suction hole 56 is connected with the vacuum pump, the protection sheet 22 is sucked into the concave part 55; and OFF regions in FIG. 20 are not connected with the vacuum pump. As the pressing tool 54 rolls on the protective sheet 22, OFF→ON→OFF is repeated; the protective sheet 22 is sucked; and application of the protective sheet 22 onto the wafer 21 proceeds while a gap is formed on each emitter area 20.

In this case, the wafer 21 must be positioned so as to correspond to the track of the pressing tool 54 having concave parts 55. Meanwhile, the protective sheet 22 need not be positioned so as to accurately correspond to any of the wafer 21 and the pressing tool 54 having concave parts 55.

Figure 21:
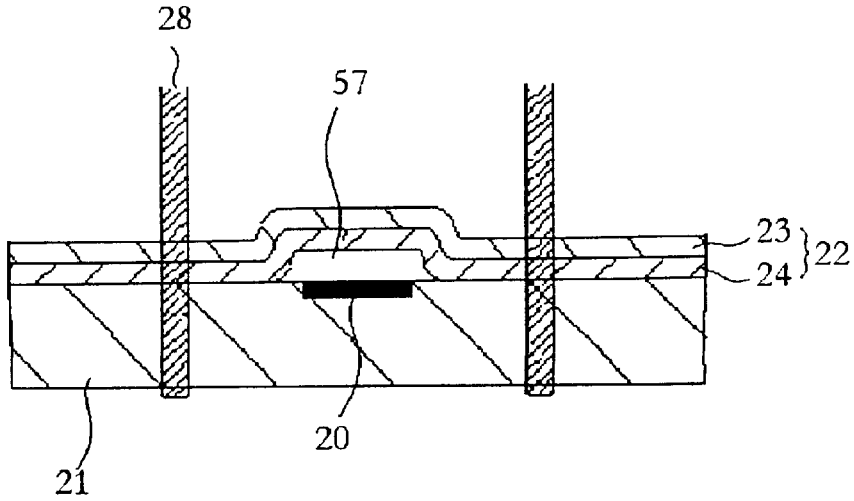
FIG. 21 is a schematic sectional view showing a protective sheet having protective areas (for each emitter area) formed by the method of FIG. 20 and a wafer portion of single cathode.

FIG. 21 shows a schematic sectional view of a protective sheet 22 and a wafer 21 portion of single device. When a pressing tool 54 having concave parts 55 is rolled on a protective sheet 22 to apply the protective sheet 22 onto a wafer 21, the protective sheet 22 comes to take a shape corresponding to the concave part 55, owing to the evacuation, at each area corresponding to the concave part 55 of pressing tool 54, i.e. in the vicinity of each emitter area 20; and a gap 57 is formed between each emitter area 20 and the adhesive layer 24 of protective sheet 22. Since there is no contact of the adhesive layer 24 with the emitter area 20, contact between them can be prevented.

The size of concave part 55 is about 0.2 to 0.5 mm in diameter when the size of device is 2 mm×2 mm and the emitter area is 0.1 mm in diameter. The depth of concave part 55 is about 0.1 to 1 mm, but must be varied depending upon the thickness of the base material and adhesive layer of protective sheet. The size of concave part 55 is not restricted to the above-mentioned level and can be such that the gap 57 is formed so as to cover the emitter area 20 and a sufficient bonded area between protective sheet and wafer is secured from one end of the gap 57 to a dicing position 28. The shape of concave part 55 can be a rectangular shape, a circular shape, a polygonal shape, an elliptical shape or the like as long as the above-mentioned requirement is satisfied.

FIG. 20 is a case of using a pressing tool 54 with concave parts 55, having an arc-shaped section. The pressing tool may be a column-shaped roller having concave parts at the surface.

After dicing, peeling of protective sheet is conducted by UV irradiation and the use of release sheet, as in Example 1. In this Example as well, dicing from the backside of wafer 21 as shown in FIG. 9 is possible. Correspondence between each emitter area and each protective area is the same as in Example 1.

This Example has the following effects, in addition to the effects described in Example 5. The protective sheet 22 takes a shape corresponding to the concave part 55, owing to the exhaustion, at each area corresponding to the concave part 55 of pressing tool 54, i.e. in the vicinity of each emitter area 20; and a gap 57 is formed between each emitter area 20 and the adhesive layer 24 of protective sheet 22. As a result, contact between emitter and adhesive layer can be prevented reliably; there is no remaining of adhesive on emitter surface; and an excellent emission property can be obtained.

EXAMPLE 7

In this Example is described a case of using a protective sheet obtained by coating, on one side of a synthetic resin film, a uniform mixture of an UV-curing adhesive and micro-grains of glass, ceramic or the like.

Figure 22:
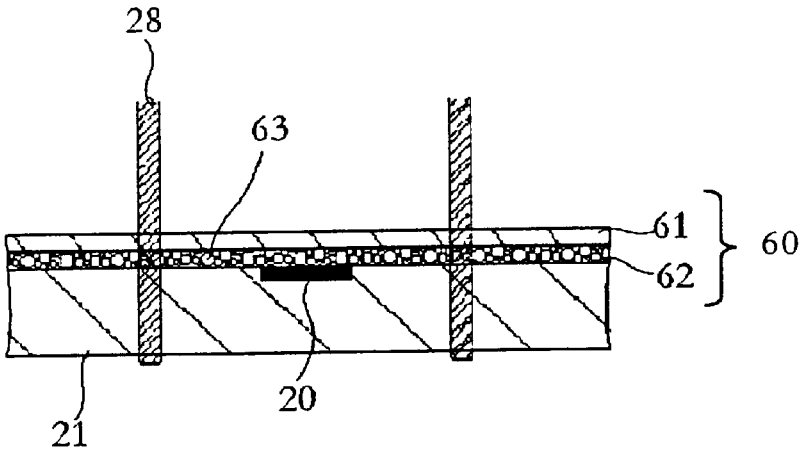
FIG. 22 is a sectional view showing an embodiment of the third process of the present invention and shows a protective sheet and a wafer portion of single cathode.

Example 7 is described with reference to some of the accompanying drawings. Here, the description which is common to Example 1, is not repeated. As the protective sheet, there is used, as shown in FIG. 22, a sheet 60 similar to that used in Example 1, obtained by forming an adhesive layer 62 of acrylic type, urethane type or the like in a thickness of about 5 to 20 $\mu$m, on one side of a base material 61 made of a polyolefin, a polyethylene or the like, having a thickness of about 50 to 100 $\mu$m. Importantly, into the adhesive layer 62 are uniformly mixed glass microspheres 63 having diameters of about 10 to 90% of the thickness of the adhesive layer 62, in an amount of about 50% by volume. In this Example, either, the protective sheet need not be fixed to a frame.

In applying such a protective sheet 60 onto a wafer 21, the wafer 21 is placed on the base of an application apparatus in a registered state; above the wafer 21 is placed the protective sheet 60 with the adhesive layer 62 directed downward, with a distance of several millimeters taken between them. In this case, no alignment is necessary.

Figure 23:
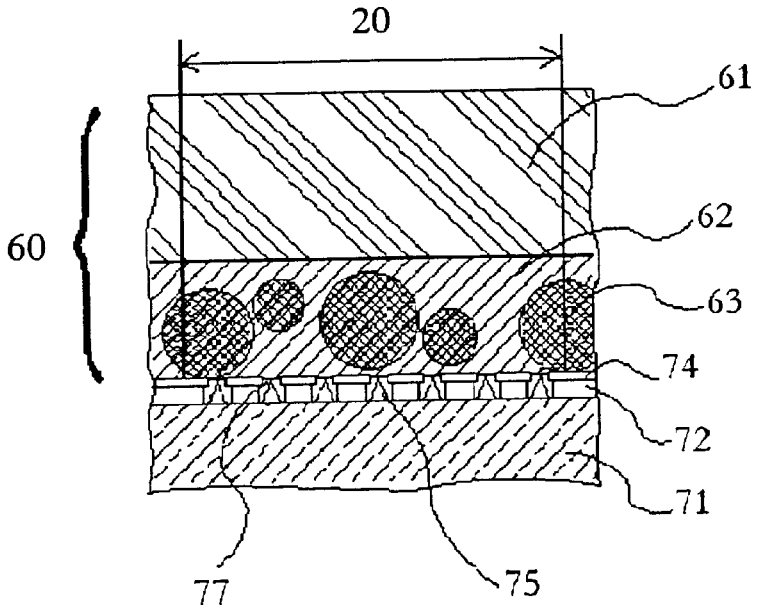
FIG. 23 is a sectional view showing the structure of the emitter area of FIG. 22.
Figure 24:
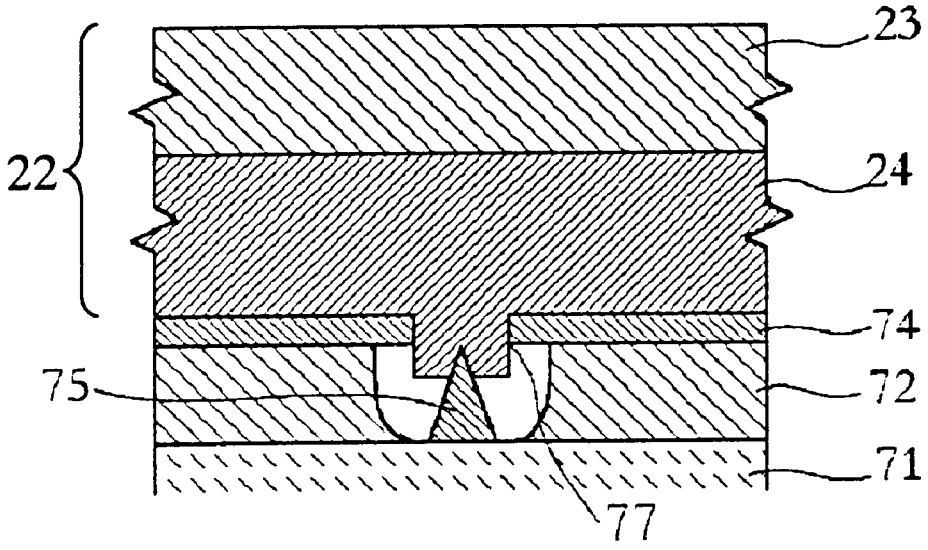
Fig. 24 (Prior Art)
FIG. 24 is a schematic sectional view showing a problem of the prior art.

Next, a jig (e.g. a roller whose surface is made of a soft rubber or the like) is rolled on the protective sheet 60 under pressure, starting from one end of the protective sheet 60, whereby the protective sheet 60 can be adhered to the wafer 21 without taking air bubbles in between their interface. FIG. 22 shows a schematic sectional view of a protective sheet 60 and a wafer 21 portion of single device. FIG. 23 is a sectional view explaining the action of the protective sheet 60 in the emitter area 20. In FIG. 23, the action of the protective sheet 60 of this Example is explained conceptually; therefore, the dimensional relationship of various materials shown in FIG. 23 is different from that employed in practical application. The adhesive layer 62 is in full contact with the wafer 21; however, since the pressure applied to the adhesive layer 62 for application of protective sheet onto wafer is reduced, between the base material 61 and the wafer 21, mostly by the microspheres 63 present in the adhesive layer 62, the adhesive of said layer receives only part of the pressure applied onto the protective sheet 60. Therefore, the flow of the adhesive layer 62, as compared with the case containing no microspheres 63, is very slight. In the emitter area 20, in particular, the penetration of adhesive into gate aperture is suppressed and the contact between emitter and adhesive can be prevented.

After dicing, peeling of protective sheet is conducted by UV irradiation and the use of release sheet, as in Example 1. In this Example as well, dicing from the backside of wafer 21 as shown in FIG. 9 is possible.

In this Example, a glass is used as the material for the microsphers 63. The material for microspheres is not restricted to a glass, and a synthetic resin, a metal, a ceramic or the like can also be used as long as it has a high hardness (a high rigidity) as compared with the adhesive used together. Particularly when micro-grains (fine particles) of silicon carbide or the like is used, since they are ordinarily used as abrasive grains, they can have a dressing effect for dicing blade, in addition to the above-mentioned effect of flow prevention of adhesive. When a plastic film such as protective sheet is cut by the use of a grindstone, there usually arise problems caused by loading of blade, etc. In this case, however, these problems may be alleviated or avoided.

This Example has been described on a particular case using particular micro-grains (material, size and content) and a particular protective sheet (thickness and materials of base material and adhesive layer). The micro-grains and the protective sheet are not restricted to the above, and there are other combinations of micro-grains and protective sheet, capable of giving the same effect.

In this Example, since the microspheres 63 absorb the pressure applied onto the protective sheet, the deformation of the adhesive layer 62 is slight. At the upper of the emitter area 20, penetration (flow) of adhesive into gate aperture is suppressed; thereby, contact between emitter and adhesive layer can be prevented; as a result, there is no remaining of adhesive on emitter surface, and an excellent emission property can be obtained. Further, since the microspheres 63 are uniformly mixed into the adhesive layer, alignment-of protective sheet is unnecessary.

What is claimed is:

1. A process for producing a field-emission cold cathode, which comprises steps of applying a protective sheet comprising a base material and an adhesive layer formed thereon, onto a wafer having a plurality of field-emitters formed at the surface and then dicing the resulting material to obtain individual field-emitters, wherein the protective sheet is fitted to a frame for protective sheet and, in that state, is provided with preventive means for flow of adhesive, at the areas of the adhesive layer corresponding to the emitter areas of the plurality of field-emitters.

2. A process according to claim 1, wherein the frame for protective sheet is provided with aligning means and wherein the formation of the preventive means for flow of adhesive and the application of the protective sheet onto the wafer are conducted by utilizing the aligning means.

3. A process according to claim 1, wherein the preventive means for flow of adhesive are the cured areas of the adhesive layer of protective sheet, obtained by using a photo-curing adhesive as the adhesive of the adhesive layer and, before the application of the protective sheet onto a wafer, irradiating a light to the areas of the adhesive layer corresponding to each emitter area of cathode, to cure these areas.

4. A process according to claim 1, wherein the preventive means for flow of adhesive are formed by forming a thin film made of a material having a rigidity higher than that of the adhesive of the adhesive layer of protective sheet, on each area of the adhesive layer corresponding to each emitter area of cathode, or by applying a foil to said area of the adhesive layer.

5. A process according to claim 4, wherein the thin film or foil is made of a metal, a glass, a ceramic, or a synthetic resin.

6. A process according to claim 1, wherein the preventive means for flow of adhesive are the adhesive-free areas of the adhesive layer of protective sheet, formed by coating an adhesive only on the areas of the base material of protective sheet, other than those corresponding to each emitter area of cathode, or by coating an adhesive on the whole surface of the base material and, before the application of the resulting protective sheet onto a wafer, removing the adhesive of only the areas corresponding to each emitter area of cathode.

7. A process according to claim 1, wherein the preventive means for flow of adhesive are the concave areas dented areas of the adhesive layer of protective sheet, formed by pressing a convex tool against the areas of the adhesive layer corresponding to each emitter area of cathode.

8. A process for producing a field-emission cold cathode, which comprises steps of applying a protective sheet comprising a base material and an adhesive layer formed thereon, onto a wafer having a plurality of field-emitters formed at the surface and then dicing the resulting material to obtain individual field-emitters, wherein the application of the protective sheet onto the wafer is conducted by the use of a pressing tool having concave parts at the positions corresponding to each emitter area of cathode.

9. A process according to claim 8, wherein the application of the protective sheet onto the wafer is conducted by making vacuum the inside of each concave part of the pressing tool to deform the protective sheet and form concave areas therein.

10. A process for producing a field-emission cold cathode, which comprises steps of applying a protective sheet comprising a base material and an adhesive layer formed thereon, onto a wafer having a plurality of field-emitters formed at the surface and then dicing the resulting material to obtain individual field-emitters, wherein the protective sheet contains, in the adhesive layer, particles having diameters of 10 to 90% of the thickness of the adhesive layer.

11. A protective sheet used in dicing, comprising a base material and an adhesive layer formed thereon, which protective sheet contains, in the adhesive layer, electrically non-conductive particles having diameters of 10 to 90% of the thickness of the adhesive layer.

12. A protective sheet according to claim 11, wherein the particles are abrasive grains.

* * * * *